US009653222B2

(12) United States Patent
Isozaki et al.

(10) Patent No.: US 9,653,222 B2
(45) Date of Patent: May 16, 2017

(54) CONTACT DEVICE, AND ELECTROMAGNETIC SWITCH IN WHICH THE CONTACT DEVICE IS USED

(71) Applicants: FUJI ELECTRIC CO., LTD., Kawasaki-shi, Kanagawa (JP); FUJI ELECTRIC FA COMPONENTS & SYSTEMS CO., LTD., Chuo-ku, Tokyo (JP)

(72) Inventors: Masaru Isozaki, Ichihara (JP); Osamu Kashimura, Hino (JP); Hiroyuki Tachikawa, Yokohama (JP); Kouetsu Takaya, Kounosu (JP); Yuji Shiba, Kounosu (JP)

(73) Assignees: FUJI ELECTRIC CO., LTD., Kawasaki-shi (JP); FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 14/505,647

(22) Filed: Oct. 3, 2014

(65) Prior Publication Data

US 2015/0034600 A1 Feb. 5, 2015

Related U.S. Application Data

(63) Continuation of application No. PCT/JP2013/002471, filed on Apr. 11, 2013.

(30) Foreign Application Priority Data

Apr. 13, 2012 (JP) ..... 2012-092448

(51) Int. Cl.
*H01H 1/06* (2006.01)
*H01H 9/44* (2006.01)
(Continued)

(52) U.S. Cl.
CPC ..... *H01H 1/06* (2013.01); *H01H 9/443* (2013.01); *H01H 33/20* (2013.01); *H01H 33/60* (2013.01);
(Continued)

(58) Field of Classification Search
CPC ..... H01H 9/44; H01H 33/18; H01H 50/00; H01H 50/38; H01H 50/546;
(Continued)

(56) References Cited

U.S. PATENT DOCUMENTS 3,064,104 A * 11/1962 Wells ..... H01H 1/20 200/16 A
4,429,198 A * 1/1984 Mori ..... H01H 9/46 218/149
(Continued)

FOREIGN PATENT DOCUMENTS

CN 101438364 A 5/2009
DE 102010032456 A1 2/2012
(Continued)

OTHER PUBLICATIONS

Machine translatrion Jp 2002-334644 (Orig. doc. Nov. 22, 2002).*
(Continued)

*Primary Examiner* — Renee Luebke
*Assistant Examiner* — William Bolton
(74) *Attorney, Agent, or Firm* — Manabu Kanesaka

(57) ABSTRACT

A contact device includes a pair of fixed contacts fixedly disposed inside an arc extinguishing chamber and maintaining a predetermined interval from each other; a movable contact disposed inside the arc extinguishing chamber, and contacting to and separating from the pair of fixed contacts; a first arc root movement promotion portion formed on the pair of fixed contacts, and promoting a movement of a root of an arc in a direction away from the movable contact, the
(Continued)

arc being generated when contacts are opened in which the movable contact moves away from the pair of fixed contacts; and a second arc root movement promotion portion formed on the movable contact, and promoting a movement of the root of the arc in a direction away from the relevant fixed contact.

10 Claims, 13 Drawing Sheets

(51) Int. Cl.

| | |
|---|---|
| ***H01H 33/20*** | (2006.01) |
| ***H01H 33/60*** | (2006.01) |
| ***H01H 50/38*** | (2006.01) |
| ***H01H 50/54*** | (2006.01) |
| ***H01H 50/02*** | (2006.01) |

(52) U.S. Cl.
CPC ..... *H01H 50/38* (2013.01); *H01H 50/546* (2013.01); *H01H 2050/025* (2013.01)

(58) Field of Classification Search
CPC .... H01H 2050/025; H01H 1/06; H01H 33/20; H01H 33/60; H01H 50/14; H01H 50/54; H01H 50/58; H01H 45/14
USPC ..... 218/148, 30, 106, 146, 36, 40; 335/57, 335/133, 201; 200/50.27, 238, 275
See application file for complete search history.

(56) References Cited

U.S. PATENT DOCUMENTS

| | | | | |
|---|---|---|---|---|
| 5,075,520 | A * | 12/1991 | Mueller | H01H 9/46 218/148 |
| 5,495,083 | A * | 2/1996 | Aymami-Pala | H01H 9/42 218/1 |
| 5,546,061 | A | 8/1996 | Okabayashi et al. | |
| 5,777,286 | A * | 7/1998 | Abot | H01H 9/465 218/36 |
| 6,300,586 | B1 * | 10/2001 | Doughty | H01H 9/46 218/148 |
| 6,703,575 | B1 * | 3/2004 | Yamamoto | H01H 9/342 218/46 |
| 6,975,194 | B2 * | 12/2005 | Nishida | H01H 51/2209 335/132 |
| 7,417,520 | B2 * | 8/2008 | Kralik | H01H 9/34 335/201 |
| 2005/0279734 | A1 * | 12/2005 | Carothers | H01H 9/46 218/40 |
| 2009/0237191 | A1 | 9/2009 | Yano et al. | |
| 2009/0243769 | A1 | 10/2009 | Takaya et al. | |
| 2010/0289604 | A1 * | 11/2010 | Kojima | H01H 9/443 335/133 |
| 2013/0181793 | A1 | 7/2013 | Bauer et al. | |

FOREIGN PATENT DOCUMENTS

| | | | |
|---|---|---|---|
| JP | 2001-176370 | A | 6/2001 |
| JP | 2002-334644 | A | 11/2002 |
| JP | 2006-019148 | A | 1/2006 |
| JP | 2008-226547 | A | 9/2008 |
| JP | 2010-073352 | A | 4/2010 |

OTHER PUBLICATIONS

PCT, "International Search Report for International Application No. PCT/JP2013/002471".
Europe Patent Office, "Search Report for EP 13775189.7," Jan. 22, 2016.
China Patent Office, "Office Action for CN 201380019082.8," Nov. 3, 2015.
Europe Patent Office, "Search Report for European Patent Application No. 13782030.4" Jun. 27, 2016.

* cited by examiner

CONTACT DEVICE, AND ELECTROMAGNETIC SWITCH IN WHICH THE CONTACT DEVICE IS USED

CROSS-REFERENCE TO RELATED APPLICATION

The present application is a continuation application of PCT International Application No. PCT/JP2013/002471 filed Apr. 11, 2013, and claims priority from Japanese Application No. 2012-092448 filed Apr. 13, 2012.

TECHNICAL FIELD

The present invention relates to a contact device including a pair of fixed contacts disposed to maintain a predetermined interval and a movable contact disposed so as to be connectable to and detachable from the fixed contacts, and to an electromagnetic switch in which the contact device is used.

BACKGROUND ART

Conventionally, various kinds of contact mechanism that, in an electromagnetic relay, electromagnetic contactor, or the like, extinguish an arc generated when contacts are opened to move a movable contact away from a fixed contact in order to change from a closed condition of the contact mechanism, wherein the fixed contact and movable contact are contacting, to an open condition by interrupting the current have been proposed as a contact device wherein switching of a current path is carried out.

For example, an electromagnetic switching device including a pair of fixed contacts, each having a fixed contact point, disposed separated by a predetermined distance, a movable contact having a movable contact point at the left and right ends thereof, disposed so as to be capable of contacting to and separating from the pair of fixed contacts, an electromagnet device that drives the movable contact, and an enclosing member that houses the movable contact and fixed contacts, has been proposed, as disclosed in PTL 1. Herein, an arc extinguishing permanent magnet is disposed parallel with the movable contact on the outer side of the enclosing member.

CITATION LIST

Patent Literature

PTL 1: JP-A-2006-19148

SUMMARY OF INVENTION

Technical Problem

However, the heretofore known example described in PTL 1 is such that, although the arc is extended by the magnetic force of the permanent magnet and thus easily extinguished, the root of an arc generated when the current is interrupted, that is, when the contacts are opened, by moving the movable contact away from an engaged condition wherein the movable contact contacts the fixed contacts, moves along the movable contact point of the movable contact to an arc extinguishing space side due to the magnetic force of the permanent magnet. There is an unresolved problem of a decrease in interruption performance due to the moving arc root stopping in a corner portion of the movable contact, a decrease in electrical field intensity occurring due to a metal vapor, or the like, emitted from the arc root, and the arc being repeatedly regenerated, or the like.

Therefore, the invention, having been contrived focusing on the unresolved problem of the heretofore known example, has an object of providing a contact device, and an electromagnetic switch in which the contact device is used, such that an arc generated between a fixed contact and a movable contact when the contacts are opened can be easily extinguished.

Solution to Problem

In order to achieve the heretofore described object, a contact device according to the invention includes a pair of fixed contacts disposed to maintain a predetermined interval inside an arc extinguishing chamber, and a movable contact disposed so as to be capable contacting to and separating from the pair of fixed contacts inside the arc extinguishing chamber. Further, a first arc root movement promotion portion is formed on each of the pair of fixed contacts, and promotes a movement in a direction away from the movable contact of a root of an arc generated when the contacts are opened and the movable contact moves away. A second arc root movement promotion portion is formed on the movable contact and promotes a movement in a direction away from the relevant fixed contact of the root of an arc generated when the contacts are opened and the movable contact moves away from the pair of fixed contacts.

According to this first aspect, the first arc root movement promotion portion is formed on the surface of the pair of fixed contacts facing the movable contact, and the second arc root movement promotion portion is formed on the surface of the movable contact facing the pair of fixed contacts. Because of this, the roots of an arc generated when the contacts are opened and the movable contact moves away from the pair of fixed contacts are moved so that the distance between the arc roots on the pair of fixed contacts and movable contact increases. Consequently, the electrical field intensity when the arc is generated increases, and it is possible to suppress or prevent regeneration of the arc, and thus to improve interruption performance.

Also, a second aspect of the contact device according to the invention is such that each of the pair of fixed contacts is formed in a C-shape in which the inner side is opened, including an upper surface plate portion, a lower surface plate portion disposed to maintain a predetermined interval from the upper surface plate portion, and a connecting plate portion linking outer ends of the upper surface plate portion and lower surface plate portion. The movable contact is movably disposed between the upper surface plate portion and lower surface plate portion.

According to the second aspect, each of the pair of fixed contacts is formed in a C-shape, because of which, when adopting an engaged condition wherein the movable contact is contacting the pair of fixed contacts and current flows between the pair of fixed contacts via the movable contact, the direction of the flow of current is reversed between the upper surface plate portion and lower surface plate portion. Because of this, it is possible to generate a Lorentz force that opposes electromagnetic repulsion force, in accordance with which it is possible to set the urging force of a contact spring to be small, and thus possible to reduce the size of the contact device configuration.

Also, a third aspect of the contact device according to the invention is such that the first arc root movement promotion portion is configured of an inclined surface in which a thickness of an end portion of the pair of fixed contacts decreases along a direction perpendicular to a direction of current flow.

According to the third aspect, an inclined surface, such as a tapered surface or arc-like surface, in which the thickness decreases along the end portion is formed in a direction perpendicular to the direction of current flow of the pair of fixed contacts, thus, a downward movement of an arc root is promoted along the inclined surface away from the movable contact.

Also, a fourth aspect of the contact device according to the invention is such that the inclined surface is configured of a tapered surface.

According to the fourth aspect, the inclined surface is a tapered surface, because of which a movable contact having an arc root movement promotion portion can be formed easily.

Also, a fifth aspect of the contact device according to the invention is such that the inclined surface is configured of an arc-like curved surface.

According to the fifth aspect, the inclined surface is an arc-like curved surface, thus there is no occurrence of a corner portion before reaching the bottom surface side of the movable contact, and arc root movement can be carried out easily and reliably.

Also, a sixth aspect of the contact device according to the invention is such that the first arc root movement promotion portion is configured of arc runners that are formed on end surfaces of the fixed contact perpendicular to the direction of current flow and protrude to the side opposite to that of the movable contact.

According to the sixth aspect, by arc runners being provided as the first arc root movement promotion portion, and the arc runners extending to the side of the pair of fixed contacts opposite to that of the movable contact, the root of an arc generated when the contacts are opened is moved in a direction away from the fixed contact without stopping in a corner portion. Because of this, the electrical field intensity when an arc is generated is increased, suppressing arc regeneration, and it is thus possible to improve interruption performance.

Also, a seventh aspect of the contact device according to the invention is such that the arc runners are formed so as to cover both side surfaces of the fixed contact.

According to the seventh aspect, when the root of an arc generated when the contacts are opened reaches a corner portion of the fixed contact, the arc root is reliably moved downward along the arc runner, and it is thus possible to improve interruption performance.

Also, an eighth aspect of the contact device according to the invention is such that the arc runners on the two side surfaces are linked by a connecting plate portion in a plane facing the movable contact.

According to the eighth aspect, the contact portions of the pair of fixed contacts facing the movable contact are covered by the arc runner, because of which movement of the root of an arc generated when the contacts are opened can be carried out smoothly.

Also, a ninth aspect of the contact device according to the invention is such that the second arc root movement promotion portion is configured of an inclined surface in which a thickness of an end portion of the movable contact decreases along a direction perpendicular to the direction of current flow of the movable contact.

According to the ninth aspect, the second arc root movement promotion portion is also such that an inclined surface, such as a tapered surface or arc-like surface, in which the thickness decreases along the end portion is formed in a direction perpendicular to the direction of current flow of the movable contact. Consequently, movement of an arc root is promoted along the inclined surface in a direction away from the pair of fixed contacts.

Also, a tenth aspect of the contact device according to the invention is such that the inclined surface is configured of a tapered surface.

According to the tenth aspect, the inclined surface is a tapered surface, because of which a movable contact having an arc root movement promotion portion can be formed easily.

Also, an eleventh aspect of the contact device according to the invention is such that the inclined surface is configured of an arc-like curved surface.

According to the eleventh aspect, the inclined surface is an arc-like curved surface, because of which there is no occurrence of a corner portion before reaching the bottom surface side of the movable contact, and arc root movement can be carried out easily and reliably.

Also, a first aspect of an electromagnetic switching device according to the invention includes the contact device according to the first to eleventh aspects, wherein the movable contact is linked to a movable iron core of an electromagnet device, and the pair of fixed contacts is connected to an external connection terminal.

According to this configuration, it is possible to provide an electromagnetic switch such that it is possible to reliably extinguish an arc generated when the contacts are opened, thus improving interruption performance, with a simple configuration.

Advantageous Effects of Invention

According to the invention, a first arc root movement promotion portion that moves the root of an arc generated when the contacts are opened in a direction away from a movable contact is formed on a pair of fixed contacts, and a second arc root movement promotion portion that moves the root of an arc generated when the contacts are opened in a direction away from the pair of fixed contacts is formed on the movable contact. Because of this, it is possible to reliably prevent an arc generated when the contacts are opened from stopping in a corner portion of the pair of fixed contacts and the movable contact, the electrical field intensity between the arc roots dropping to or below the arc voltage, and arc regeneration occurring between electrodes in the vicinity of the arc roots, and thus possible to improve interruption performance.

Also, by a contact device having the heretofore described advantage being applied to an electromagnetic switch, it is possible to provide an electromagnetic switch, such as an electromagnetic contactor or electromagnetic relay, such that it is possible to easily extinguish an arc generated when the contacts are opened, thus improving interruption performance, with a simple configuration.

DESCRIPTION OF EMBODIMENTS

Hereafter, a description will be given, based on the drawings, of embodiments of the invention.

Figure 1:
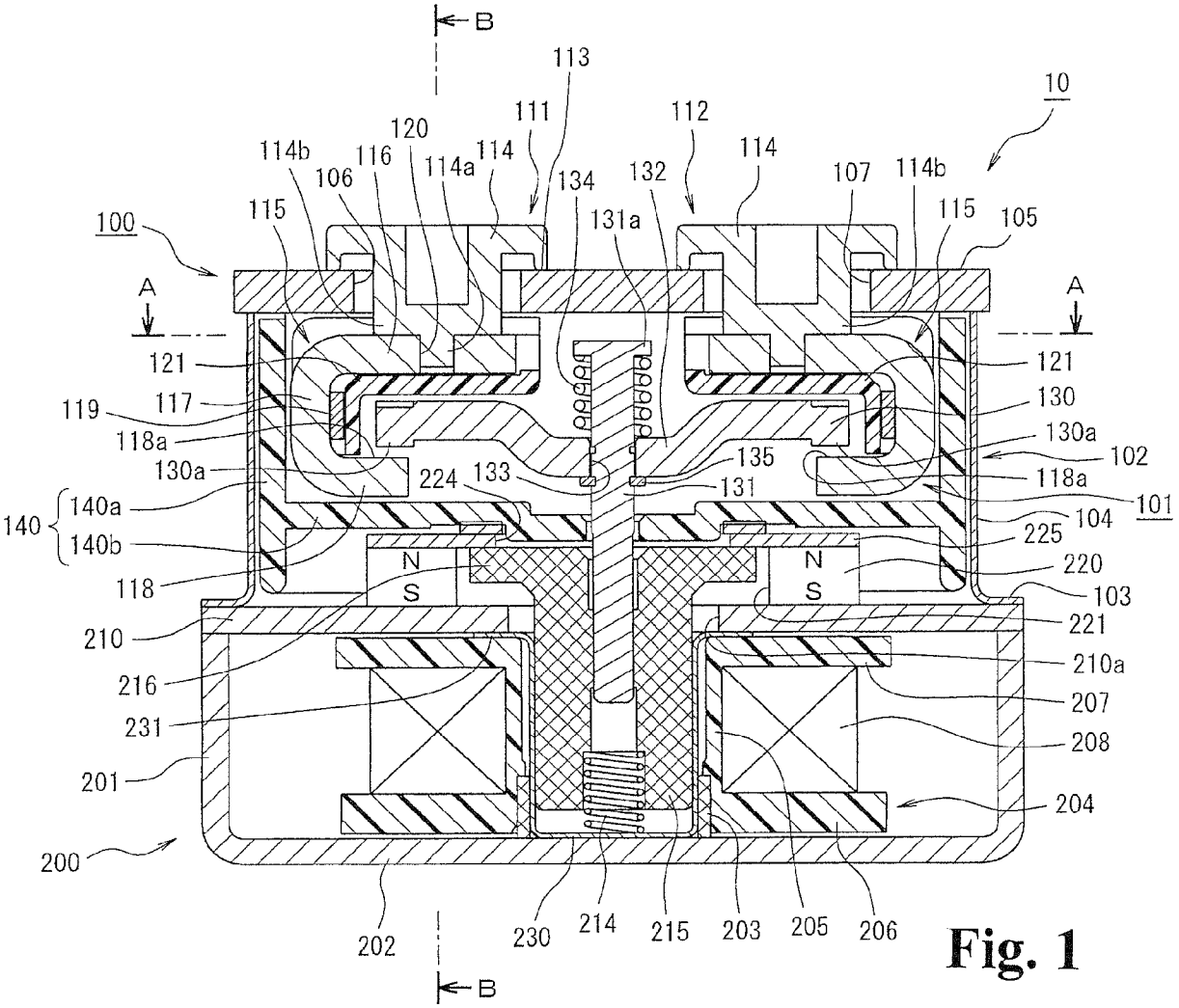
FIG. 1 is a sectional view showing a first embodiment of an electromagnetic switch according to the invention.
Figure 2B:
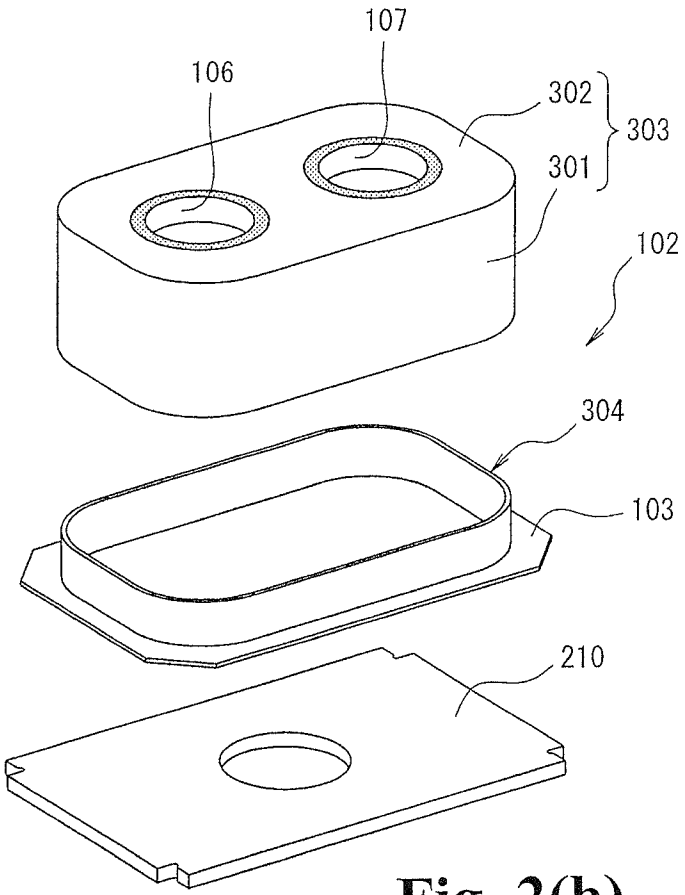
FIGS. 2(*a*), 2(*b*) are exploded perspective views of a contact housing case.
Figure 2A:
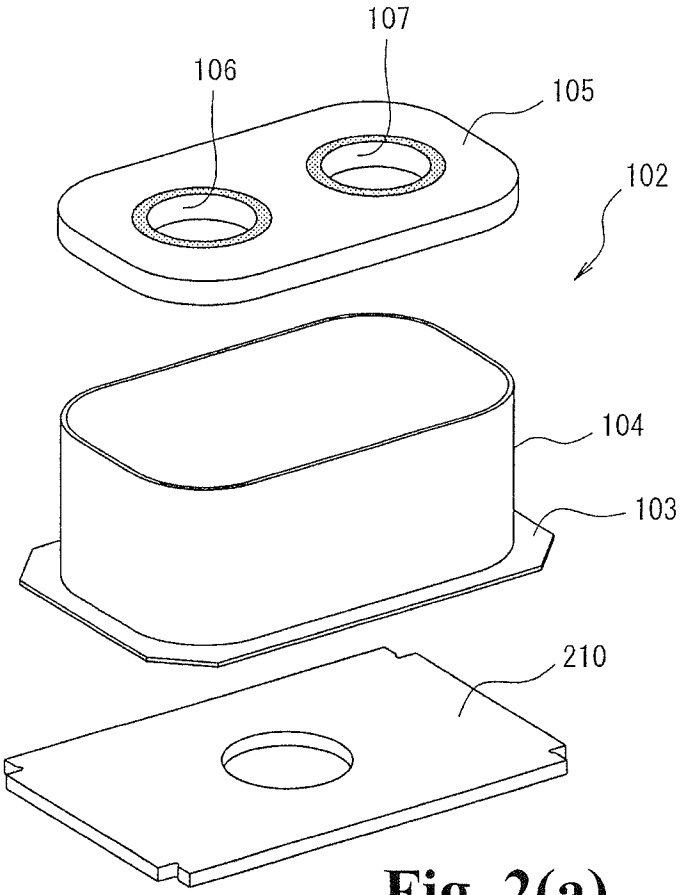

FIG. 1 is a sectional view showing a first embodiment when an electromagnetic switch according to the invention is applied to an electromagnetic contactor, while FIGS. 2(*a*), 2(*b*) are exploded perspective views of a contact housing case.

In FIG. 1 and FIGS. 2(*a*), 2(*b*), reference 10 is an electromagnetic contactor, and the electromagnetic contactor 10 is configured of a contact device 100 in which is disposed a contact mechanism, and an electromagnet unit 200 that drives the contact device 100.

The contact device 100 has a contact housing case 102 as an arc extinguishing chamber that houses a contact mechanism 101, as is clear from FIG. 1 and FIGS. 2(*a*), 2(*b*). The contact housing case 102 includes a metal tubular body 104 having on a metal lower end portion a flange portion 103 protruding outward, and a fixed contact support insulating substrate 105 forming a top plate configured of a plate-like ceramic insulating substrate that closes off the upper end of the metal tubular body 104, as shown in FIG. 2(*a*).

The metal tubular body 104 is such that the flange portion 103 thereof is seal joined and fixed to an upper portion magnetic yoke 210 of the electromagnet unit 200, to be described hereafter.

Also, through holes 106 and 107 in which are inserted a pair of fixed contacts 111 and 112, to be described hereafter, are formed maintaining a predetermined interval in a central portion of the fixed contact support insulating substrate 105. A metalizing process is performed around the through holes 106 and 107 on the upper surface side of the fixed contact support insulating substrate 105, and in a position on the lower surface side that contacts the metal tubular body 104. In order to carry out the metalizing process, copper foil is formed around the through holes 106 and 107, and in the position that contacts the metal tubular body 104, in a condition wherein a plurality of fixed contact support insulating substrate 105 is arranged vertically and horizontally on a flat surface.

The contact mechanism 101, as shown in FIG. 1, includes the pair of fixed contacts 111 and 112 inserted into and fixed in the through holes 106 and 107 of the fixed contact support insulating substrate 105 of the contact housing case 102.

Each of the fixed contacts 111 and 112 includes a support conductor portion 114, having on an upper end a flange portion 113 protruding outward, inserted into the through holes 106 and 107 of the fixed contact support insulating substrate 105, and a C-shaped contact conductor portion 115, the inner side of which is opened, linked to the support conductor portion 114 and disposed on the lower surface side of the fixed contact support insulating substrate 105.

The contact conductor portion 115 includes an upper plate portion 116 as a second connecting plate portion extending to the outer side along the line of the lower surface of the fixed contact support insulating substrate 105, an intermediate plate portion 117 as a connecting plate portion extending downward from the outer side end portion of the upper plate portion 116, and a lower plate portion 118 as a contact plate portion extending from the lower end side of the intermediate plate portion 117, parallel with the upper plate portion 116, to the inner side, that is, in a direction facing the fixed contacts 111 and 112. Because of this, the contact conductor portion 115 is formed in a C-shape wherein the upper plate portion 116 is added to an L-shape formed by the intermediate plate portion 117 and lower plate portion 118.

Herein, the support conductor portion 114 and contact conductor portion 115 are fixed by, for example, brazing in a condition in which a pin 114*a* formed protruding on the lower end surface of the support conductor portion 114 is inserted into a through hole 120 formed in the upper plate portion 116 of the contact conductor portion 115. The fixing of the support conductor portion 114 and contact conductor portion 115, not being limited to brazing, may be such that the pin 114*a* is fitted into the through hole 120, or an external thread is formed on the pin 114*a* and an internal thread formed in the through hole 120, and the two are screwed together.

Figure 3:
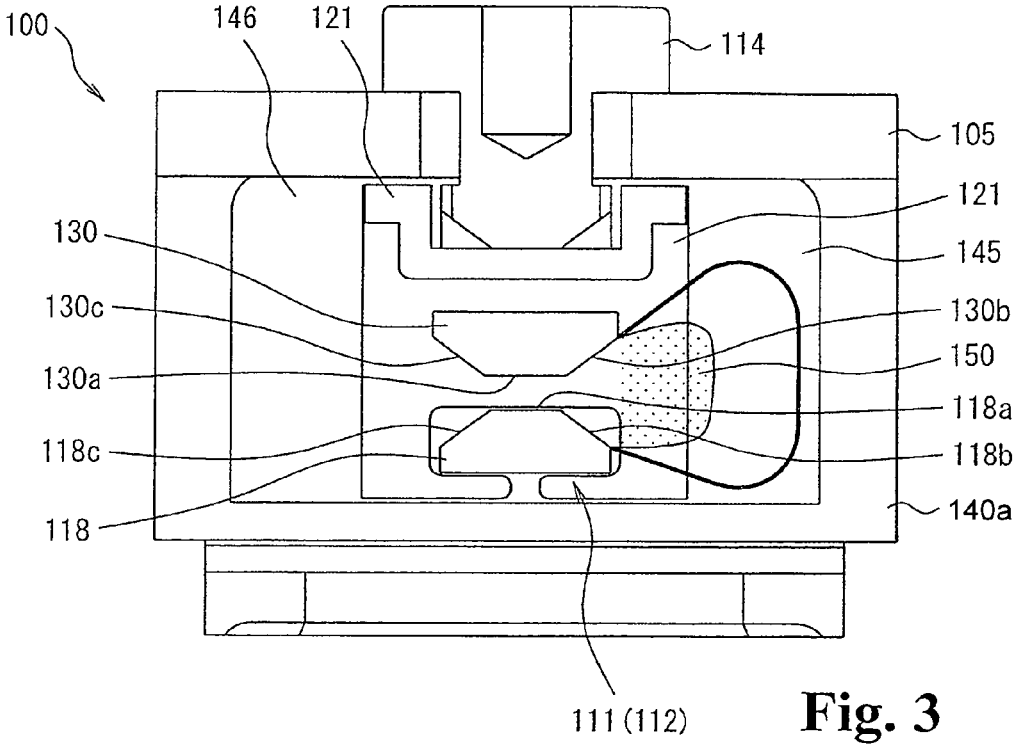
FIG. 3 is a schematic sectional view along the line B-B of FIG. 1.

Also, the lower plate portion 118 of the contact conductor portion 115 is such that a cross-section of a leading end side contact portion in a forward-back direction intersecting with the direction of current flow is configured as shown in FIG. 3. That is, a central portion in the forward-back direction is a flat portion 118*a* having a predetermined thickness. Tapered surfaces 118*b* and 118*c* configuring a first arc root movement promotion portion whose thickness decreases with proximity to an end surface side, wherein the distance from a movable contact 130, to be described hereafter, gradually increases along surfaces inclining downward to the left and downward to the right, are formed one on either end side in the forward-back direction of the flat portion 118*a*.

When an arc generated when the contacts are opened as described hereafter is extended by the magnetic force of arc extinguishing permanent magnets 143 and 144, to be described hereafter, the root of the arc is swiftly moved in a direction away from the movable contact 130 by the tapered surfaces 118*b* and 118*c* being formed on the front and back sides of the flat portion 118*a* in this way.

Also, a magnetic plate 119 of a C-shape when seen in plan view is mounted so as to cover the inner side surface of the intermediate plate portion 117 in the contact conductor portion 115 of the fixed contacts 111 and 112. By disposing the magnetic plate 119 so as to cover the inner side surface of the intermediate plate portion 117 in this way, it is possible to shield a magnetic field generated by current flowing through the intermediate plate portion 117.

Because of this, an arc is generated when, from a condition in which flat portions 130*a* of the movable contact 130 are contacting the flat portions 118*a* of the fixed contacts 111 and 112, the flat portions 130*a* move away upward, as will be described hereafter. In this case, it is possible to prevent interference between a magnetic field caused by the current flowing through the intermediate plate portion 117 and a magnetic field caused by the arc generated between the flat portions 118*a* of the fixed contacts 111 and 112 and the flat portions 130*a* of the movable contact 130. Consequently, it is possible to prevent the two magnetic fields from repelling each other, the arc being moved to the inner side along the line of the movable contact 130 by this electromagnetic repulsion force, and interruption of the arc becoming difficult. It being sufficient that it is possible to shield a magnetic field generated by current flowing through the intermediate plate portion 117, the magnetic plate 119 may be formed so as to cover the periphery of the intermediate plate portion 117.

Furthermore, an insulating cover 121, made of a synthetic resin material, that regulates arc generation is mounted on the contact conductor portion 115 of each of the fixed contacts 111 and 112. The insulating cover 121 covers the inner peripheral surfaces of the upper plate portion 116 and intermediate plate portion 117 of the contact conductor portion 115, as shown in FIGS. 4(*a*) and 4(*b*).

The insulating cover 121 includes an L-shaped plate portion 122 that follows the inner peripheral surfaces of the upper plate portion 116 and intermediate plate portion 117, side plate portions 123 and 124, each extending upward and outward from front and rear end portions of the L-shaped plate portion 122, that cover side surfaces of the upper plate portion 116 and intermediate plate portion 117 of the contact conductor portion 115, and a fitting portion 125, formed on the inward side from the upper end of the side plate portions 123 and 124, that fits onto a small diameter portion 114*b* formed on the support conductor portion 114 of the fixed contacts 111 and 112.

Figure 4A:
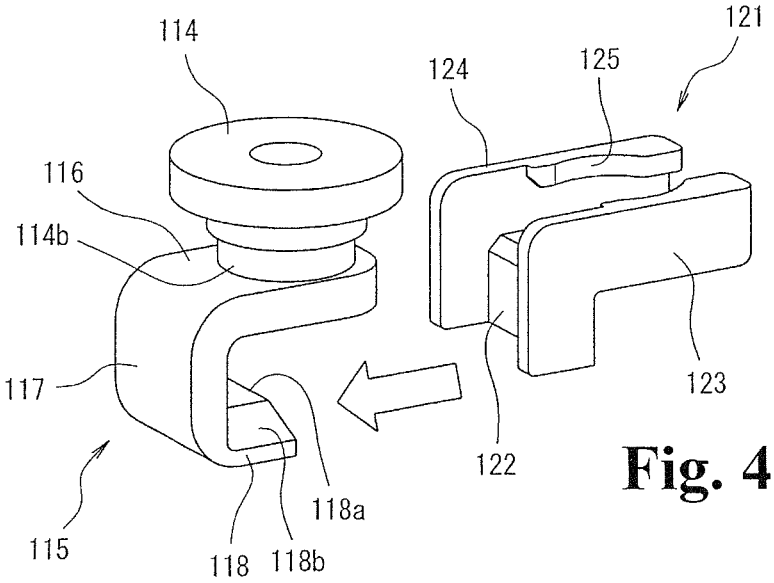
FIGS. 4(*a*)-4(*c*) are diagrams showing an insulating cover of a contact device, wherein FIG. 4(*a*) is a perspective view, FIG. 4(*b*) is a plan view before mounting, and FIG. 4(*c*) is a plan view after mounting.
Figure 4B:
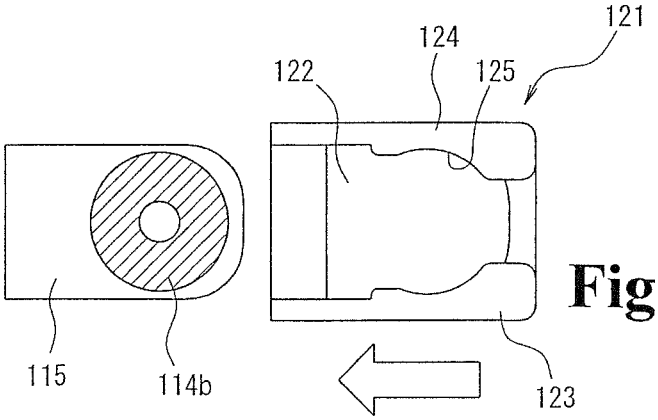
Figure 4C:
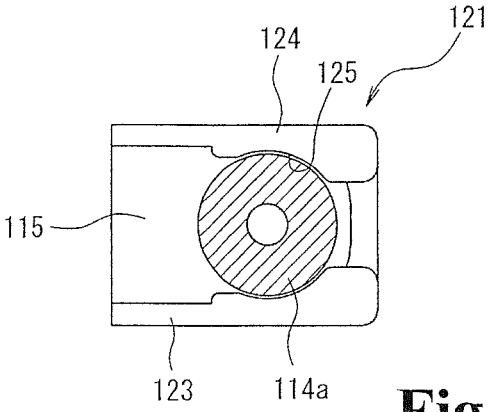

Consequently, the insulating cover 121 is placed in a condition in which the fitting portion 125 is facing the small diameter portion of the support conductor portion 114 of the fixed contacts 111 and 112, as shown in FIGS. 4 (*a*) and 4(*b*), after which, the fitting portion 125 is fitted onto the small diameter portion 114*b* of the support conductor portion 114 by pushing the insulating cover 121 onto the small diameter portion 114*b*, as shown in FIG. 4(*c*).

Figure 5A:
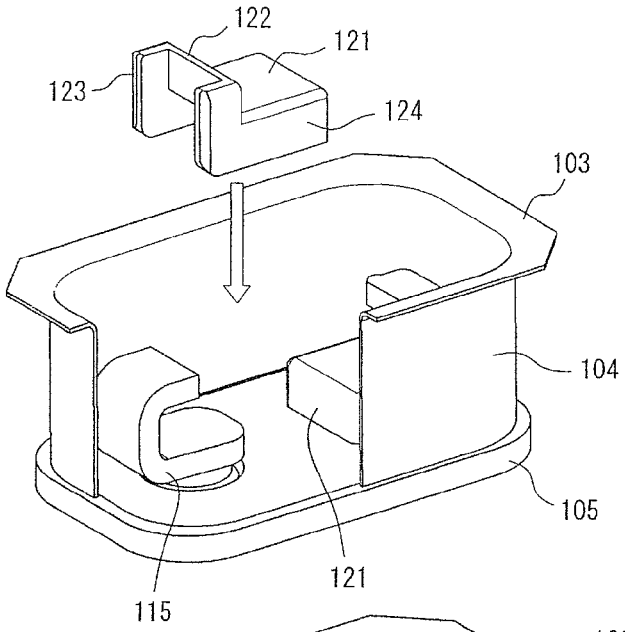
FIGS. 5(*a*)-5(*c*) are illustrations showing an insulating cover mounting method.
Figure 5B:
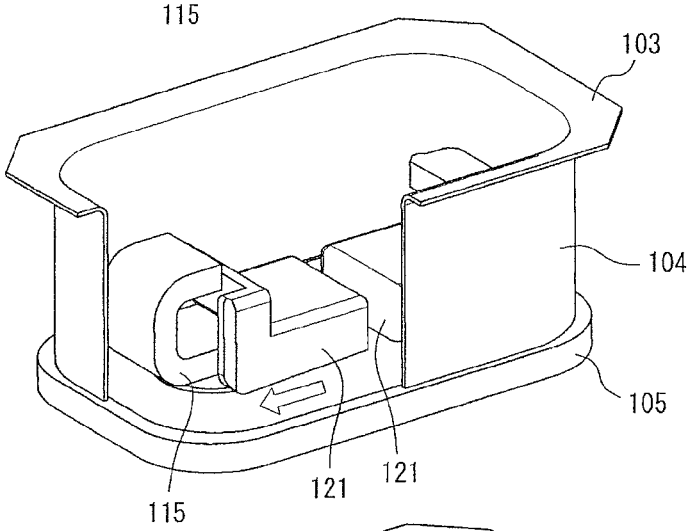
Figure 5C:
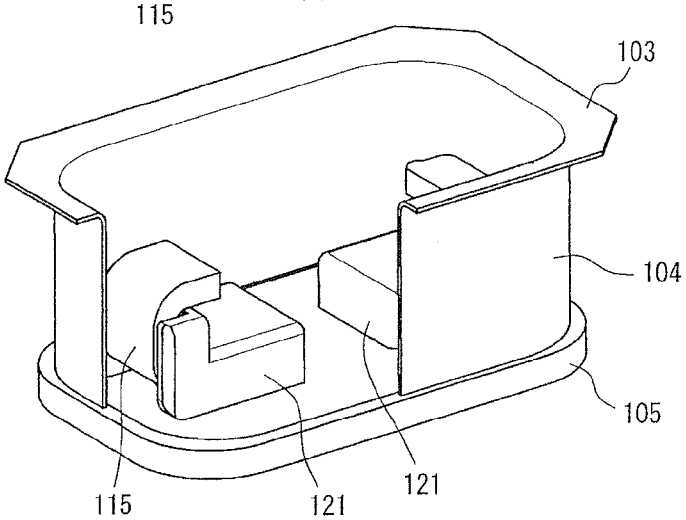

Actually, with the contact housing case 102 after the fixed contacts 111 and 112 have been attached in a condition wherein the fixed contact support insulating substrate 105 is on the lower side, the insulating cover 121 is inserted from an upper aperture portion between the fixed contacts 111 and 112 in a condition vertically the reverse of that in FIGS. 5(*a*) to 5(*c*), as shown in FIG. 5(*a*).

Next, in a condition in which the fitting portion 125 is contacting the fixed contact support insulating substrate 105, as shown in FIG. 5(*b*), the fitting portion 125 is engaged with and fixed to the small diameter portion 114*b* of the support conductor portion 114 of the fixed contacts 111 and 112 by pushing the insulating cover 121 to the outer side, as shown in FIG. 5(*c*).

By mounting the insulating cover 121 on the contact conductor portion 115 of the fixed contacts 111 and 112 in this way, only the upper surface side of the lower plate portion 118 of the inner peripheral surface of the contact conductor portion 115 is exposed, and is taken to be a contact portion.

Further, the movable contact 130 is disposed in such a way that both end portions are disposed in the contact conductor portion 115 of the fixed contacts 111 and 112. The movable contact 130 is supported by a connecting shaft 131 fixed to a movable plunger 215 of the electromagnet unit 200, to be described hereafter. The movable contact 130 is such that, as shown in FIG. 1, a central portion in the vicinity of the connecting shaft 131 protrudes downward, whereby a depressed portion 132 is formed, and a through hole 133 in which the connecting shaft 131 is inserted is formed in the depressed portion 132.

A flange portion 131*a* protruding outward is formed on the upper end of the connecting shaft 131. The connecting shaft 131 is inserted from the lower end side into a contact spring 134, then inserted into the through hole 133 of the movable contact 130, bringing the upper end of the contact spring 134 into contact with the flange portion 131*a*. The moving contact 130 is positioned using, for example, a C-ring 135 so as to obtain a predetermined urging force from the contact spring 134.

Further, a sectional form of contact portions on the left and right ends of the movable contact 130 in a direction intersecting with the energizing direction of current flow is configured in the same way as that of the lower plate portion 118 that forms the contact portions of the pair of fixed contacts 111 and 112. That is, the thick flat portion 130*a* is formed in a central portion in the forward-back direction. Tapered surfaces 130*b* and 130*c* are formed as inclined surfaces configuring a second arc root movement promotion portion whose thickness decreases, and distance from the pair of fixed contacts 111 and 112 increases, from the front and back end portions of the flat portion 130*a* toward the front and back end portions of the movable contact 130.

In this way, in the embodiment, the tapered surfaces 130*b* and 130*c* are formed in contact portions of the movable contact 130 facing the lower plate portion 118 that forms the contact portions of the pair of fixed contacts 111 and 112. Because of this, when an arc generated when the contacts are opened, to be described hereafter, is extended outward by the magnetic force of the arc extinguishing permanent magnets 143 and 144, the root of the arc can be swiftly moved to the outer side.

The movable contact 130, in a released condition, takes on a condition wherein the flat portions 130*a* at either end and the flat portions 118*a* of the lower plate portions 118 of the contact conductor portions 115 of the fixed contacts 111 and 112 are separated from each other and maintaining a predetermined interval. Also, the movable contact 130 is set so that, in an engaged position, the contact portions at either end contact the flat portions 118*a* of the lower plate portions 118 of the contact conductor portions 115 of the fixed contacts 111 and 112 at a predetermined contact pressure due to the contact spring 134.

Furthermore, an insulating cylinder 140 formed in a bottomed tubular form of a bottom plate portion 140*b* and a tubular body 140*a* formed on the upper surface of the bottom plate portion 140*b* is disposed on the inner peripheral surface of the metal tubular body 104 of the contact housing case 102, as shown in FIG. 1.

The insulating cylinder 140 is made of, for example, a synthetic resin, and the bottom plate portion 140*b* and tubular body 140*a* are formed integrally. Magnet housing cylinders 141 and 142 are formed integrally as magnet housing portions in positions on the insulating cylinder 140 facing the side surfaces of the movable contact 130. Arc extinguishing permanent magnets 143 and 144 are inserted into and fixed in the magnet housing cylinders 141 and 142.

Figure 6:
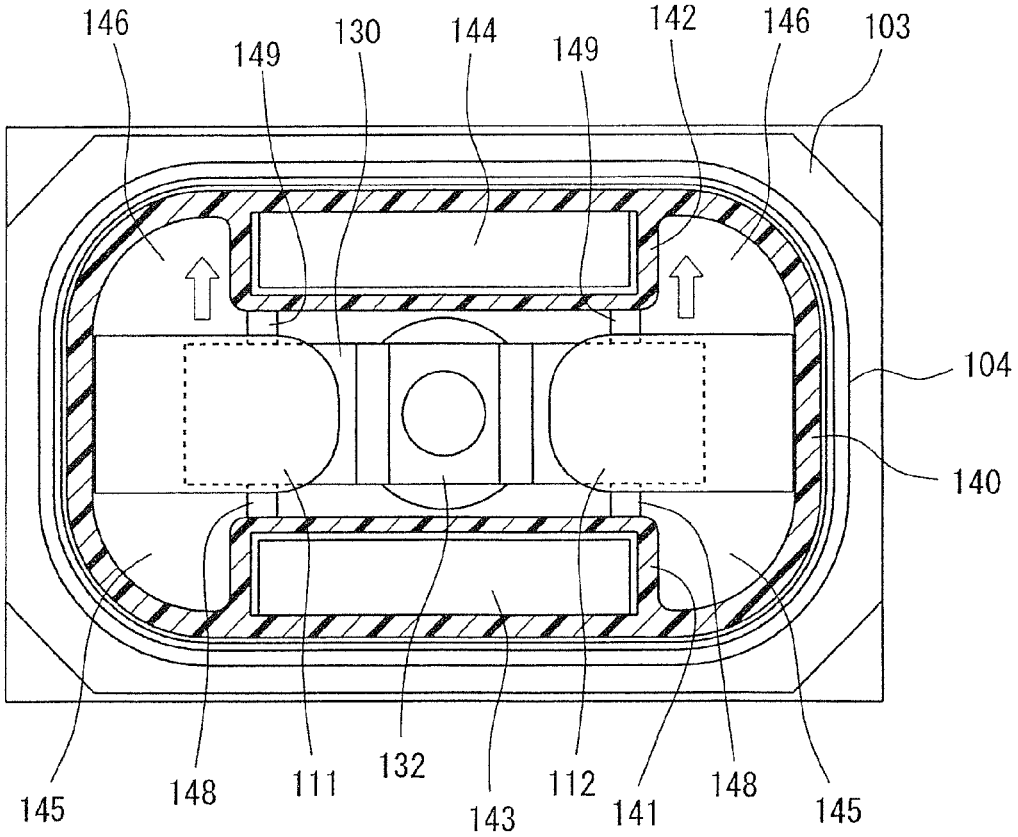
FIG. 6 is a sectional view along the line A-A in FIG. 1.

The arc extinguishing permanent magnets 143 and 144 are magnetized in a thickness direction so that mutually opposing magnetic pole faces thereof are homopolar, for example, N-poles. Also, the arc extinguishing permanent magnets 143 and 144 are set so that both end portions in a left-right direction are slightly inward of positions in which the contact portions of the fixed contacts 111 and 112 and the contact portions of the movable contact 130 are opposed, as shown in FIG. 6. Further, arc extinguishing spaces 145 and 146 are formed on the outer sides in a left-right direction, that is, the longitudinal direction of the movable contact, of the magnet housing cylinders 141 and 142 respectively.

Also, movable contact guide members 148 and 149, which regulate the turning of the movable contact 130, are formed protruding, sliding against side edges of the magnet housing cylinders 141 and 142 toward either end of the movable contact 130.

Consequently, the insulating cylinder 140 includes a function of positioning the arc extinguishing permanent magnets 143 and 144 using the magnet housing cylinders 141 and 142, a protective function of protecting the arc extinguishing permanent magnets 143 and 144 from an arc, and an insulating function preventing the arc from affecting the metal tubular body 104, which increases external rigidity.

Further, by disposing the arc extinguishing permanent magnets 143 and 144 on the inner peripheral surface side of the insulating cylinder 140, it is possible to bring the arc extinguishing permanent magnets 143 and 144 near to the movable contact 130. Because of this, as shown in FIG. 7(*a*), magnetic flux $\phi$ emanating from the N-pole sides of the two arc extinguishing permanent magnets 143 and 144 crosses portions in which the flat portions 118*a* of the fixed contacts 111 and 112 and the flat portions 130*a* of the movable contact 130 are facing in a left-right direction, from the inner side to the outer side, with a large flux density.

Figure 7A:
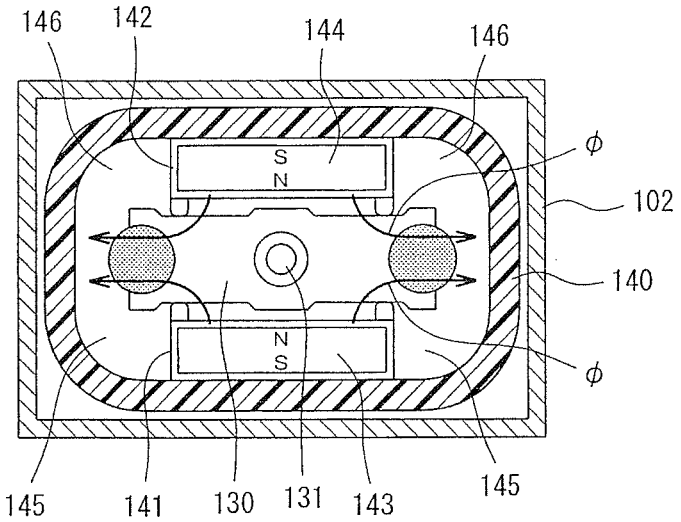
FIGS. 7(*a*)-7(*c*) are illustrations accompanying a description of arc extinguishing by an arc extinguishing permanent magnet according to the invention.
Figure 7B:
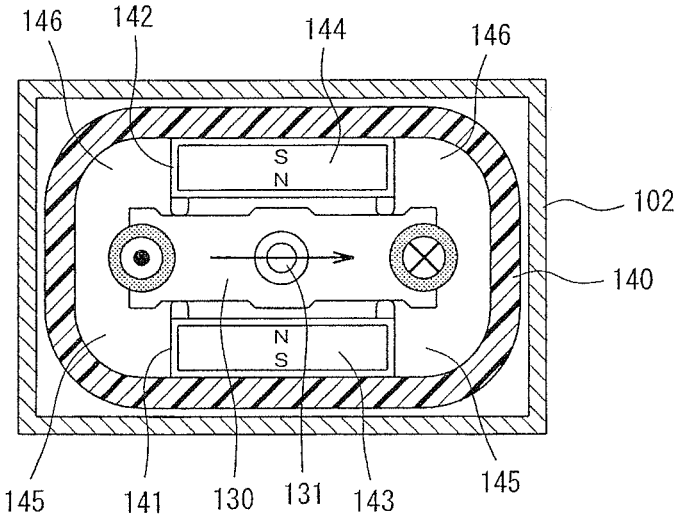
Figure 7C:
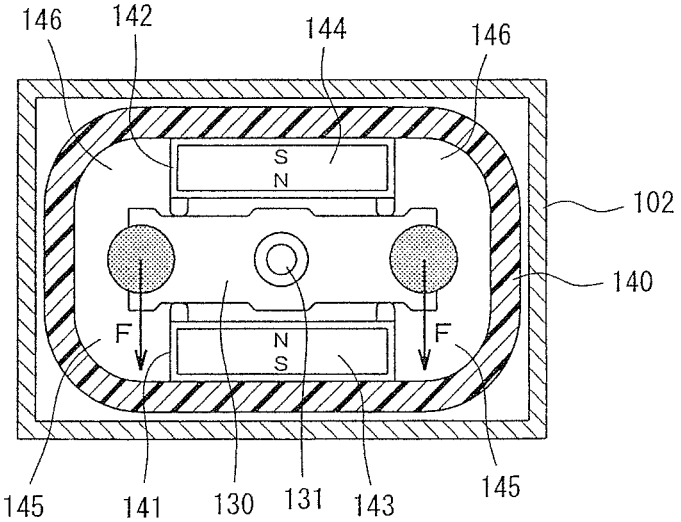

Consequently, assuming that the fixed contact 111 is connected to a current supply source and the fixed contact 112 is connected to a load side, the current direction in the engaged condition is such that the current flows from the fixed contact 111 through the movable contact 130 to the fixed contact 112, as shown in FIG. 7(*b*). Then, when changing from the engaged condition to the released condition by moving the movable contact 130 away upward from the fixed contacts 111 and 112, an arc is generated between the flat portions 118*a* of the fixed contacts 111 and 112 and the flat portions 130*a* of the movable contact 130.

The arc is extended to the arc extinguishing space 145 side on the arc extinguishing permanent magnet 143 side by the magnetic flux $\phi$ from the arc extinguishing permanent magnets 143 and 144. At this time, as the arc extinguishing spaces 145 and 146 are formed as widely as the thickness of the arc extinguishing permanent magnets 143 and 144, it is possible to obtain a long arc length, and thus possible to reliably extinguish the arc.

Figure 8A:
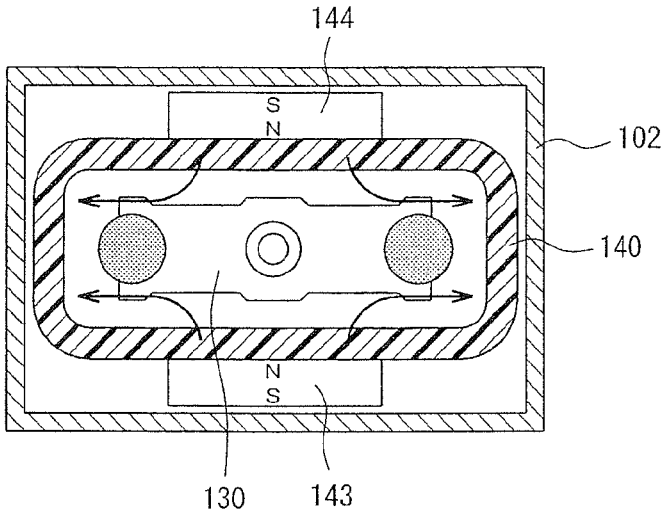
FIGS. 8(*a*)-8(*c*) are illustrations accompanying a description of arc extinguishing when the arc extinguishing permanent magnet is disposed on the outer side of an insulating case.
Figure 8B:
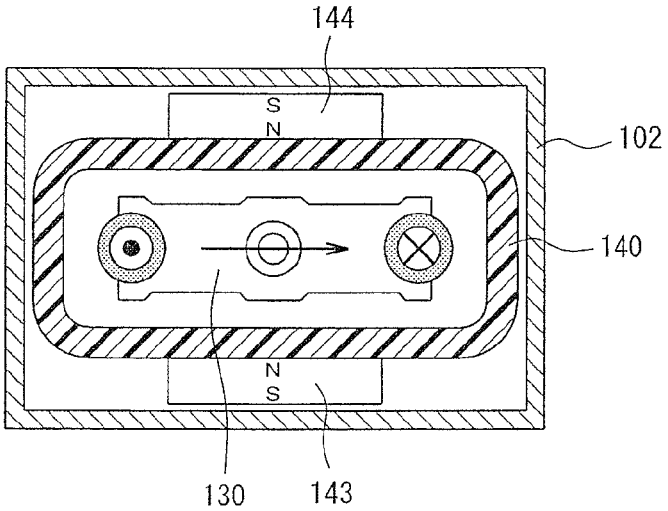
Figure 8C:
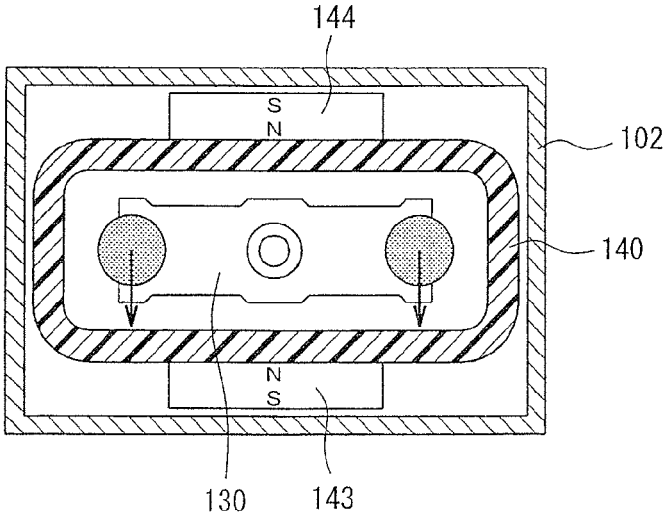

Incidentally, when the arc extinguishing permanent magnets 143 and 144 are disposed on the outer side of the insulating cylinder 140, as shown in FIGS. 8(*a*) to 8(*c*), there is an increase in the distance to the positions in which the contact portions of the fixed contacts 111 and 112 and the contact portions of the movable contact 130 are facing each other. Because of this, when the same permanent magnets as in this embodiment are applied, the density of the magnetic flux crossing the arc decreases.

Because of this, the Lorentz force acting on an arc generated when shifting from the engaged condition to the released condition decreases, and it is no longer possible to sufficiently extend the arc. In order to improve the arc extinguishing performance, it is necessary to increase the magnetic force of the arc extinguishing permanent magnets 143 and 144. Moreover, in order to shorten the distance between the arc extinguishing permanent magnets 143 and 144 and the contact portions of the fixed contacts 111 and 112 and movable contact 130, it is necessary to reduce the depth in a front-back direction of the insulating cylinder 140. Consequently, there is a problem in that it is not possible to secure sufficient arc extinguishing space to extinguish the arc.

However, according to the heretofore described embodiment, the arc extinguishing permanent magnets 143 and 144 are disposed on the inner side of the insulating cylinder 140, because of which problems occurring when the arc extinguishing permanent magnets 143 and 144 are disposed on the outer side of the insulating cylinder 140 can be resolved.

The electromagnet unit 200, as shown in FIG. 1, has a magnetic yoke 201 of a flattened U-shape when seen from the side, and a cylindrical auxiliary yoke 203 is fixed in a central portion of a bottom plate portion 202 of the magnetic yoke 201. A spool 204 is disposed on the outer side of the cylindrical auxiliary yoke 203.

The spool 204 is configured of a central cylinder portion 205 in which the cylindrical auxiliary yoke 203 is inserted, a lower flange portion 206 protruding outward in a radial direction from a lower end portion of the central cylinder portion 205, and an upper flange portion 207 protruding outward in a radial direction from slightly below the upper end of the central cylinder portion 205. Further, an exciting coil 208 is mounted wound in a housing space configured of the central cylinder portion 205, lower flange portion 206, and upper flange portion 207.

Further, an upper magnetic yoke 210 is fixed between upper ends forming an opened end of the magnetic yoke 201. A through hole 210*a* facing the central cylinder portion 205 of the spool 204 is formed in a central portion of the upper magnetic yoke 210.

Further, the movable plunger 215, in which is disposed a return spring 214 between a bottom portion and the bottom plate portion 202 of the magnetic yoke 201, is disposed in the central cylinder portion 205 of the spool 204 so as to be able to slide up and down. A peripheral flange portion 216 protruding outward in a radial direction is formed on the movable plunger 215, on an upper end portion protruding upward from the upper magnetic yoke 210.

Also, a permanent magnet 220 formed in a ring-form, whose external form is, for example, rectangular and which has a circular central aperture 221, is fixed to the upper surface of the upper magnetic yoke 210 so as to enclose the peripheral flange portion 216 of the movable plunger 215. The permanent magnet 220 is magnetized in an up-down direction, that is, a thickness direction, so that the upper end side is, for example, an N-pole while the lower end side is an S-pole.

Further, an auxiliary yoke 225 of the same external form as the permanent magnet 220, and having a through hole 224 with an inner diameter smaller than the outer diameter of the peripheral flange portion 216 of the movable plunger 215, is fixed to the upper end surface of the permanent magnet 220. The peripheral flange portion 216 of the movable plunger 215 contacts the lower surface of the auxiliary yoke 225.

The form of the permanent magnet 220 not being limited to that heretofore described, it can also be formed in a circular ring form, and in fact, the external form can be any form, such as circular or polygonal, provided that the inner peripheral surface is of a form tailored to the form of the peripheral flange portion 216.

Also, the connecting shaft 131 that supports the movable contact 130 is screwed to the upper end surface of the movable plunger 215.

Further, the movable plunger 215 is covered with a cap 230 formed in a bottomed tubular form made of a non-magnetic body, and a flange portion 231 formed extending outward in a radial direction on an opened end of the cap 230 is seal joined to the lower surface of the upper magnetic yoke 210. By so doing, a hermetic receptacle, wherein the contact housing case 102 and cap 230 are in communication via the through hole 210*a* of the upper magnetic yoke 210, is formed.

Further, a gas such as hydrogen gas, nitrogen gas, a mixed gas of hydrogen and nitrogen, air, or $SF_6$ is encapsulated inside the hermetic receptacle formed by the contact housing case 102 and cap 230.

Next, a description will be given of an operation of the heretofore described embodiment.

For now, it is assumed that the fixed contact 111 is connected to, for example, a power supply source that supplies a large current, while the fixed contact 112 is connected to a load.

In this condition, the exciting coil 208 in the electromagnet unit 200 is in a non-excited state, and there exists a released condition wherein no exciting force causing the movable plunger 215 to descend is being generated in the electromagnet unit 200.

In this released condition, the movable plunger 215 is urged in an upward direction away from the upper magnetic yoke 210 by the return spring 214. Simultaneously with this, a suctioning force caused by the permanent magnet 220 acts on the auxiliary yoke 225, and the peripheral flange portion 216 of the movable plunger 215 is suctioned. Because of this, the upper surface of the peripheral flange portion 216 of the movable plunger 215 contacts the lower surface of the auxiliary yoke 225.

Because of this, the flat portions 130*a* forming the contact portions of the movable contact 130 of the contact mechanism 101 connected to the movable plunger 215 via the connecting shaft 131 are separated by a predetermined distance upward from the flat portions 118*a* forming the contact portions of the fixed contacts 111 and 112. Because of this, the current path between the fixed contacts 111 and 112 is in an interrupted condition, and the contact mechanism 101 is in a condition wherein the contacts are opened.

In this way, as the urging force of the return spring 214 and the suctioning force of the ring-form permanent magnet 220 both act on the movable plunger 215 in the released condition, there is no unplanned downward movement of the movable plunger 215 due to external vibration, shock, or the like, and it is thus possible to reliably prevent malfunction.

In order to supply power to the load from the released condition, the exciting coil 208 of the electromagnet unit 200 is excited, an exciting force is generated in the electromagnet unit 200, and the movable plunger 215 descends against the urging force of the return spring 214 and the suctioning force of the ring-form permanent magnet 220. The descent of the movable plunger 215 is stopped by the lower surface of the peripheral flange portion 216 contacting the upper surface of the upper magnetic yoke 210.

By the movable plunger 215 descending in this way, the movable contact 130 connected to the movable plunger 215 via the connecting shaft 131 also descends, and the flat portions 130*a* of the movable contact 130 contact the flat portions 118*a* of the fixed contacts 111 and 112 with the contact pressure of the contact spring 134.

Because of this, there exists a closed contact condition wherein the large current of the external power supply source is supplied to the load via the fixed contact 111, movable contact 130, and fixed contact 112.

At this time, an electromagnetic repulsion force is generated between the fixed contacts 111 and 112 and the movable contact 130 in a direction such as to cause the contacts of the movable contact 130 to open.

However, the fixed contacts 111 and 112 are such that the contact conductor portion 115 is formed of the upper plate portion 116, intermediate plate portion 117, and lower plate portion 118, as shown in FIG. 1. Because of this, the current in the upper plate portion 116 and lower plate portion 118 and the current in the opposing movable contact 130 flow in opposite directions. Consequently, from the relationship between a magnetic field formed by the lower plate portions 118 of the fixed contacts 111 and 112 and the current flowing through the movable contact 130, it is possible, in accordance with Fleming's left-hand rule, to generate a Lorentz force that presses the movable contact 130 against the flat portions 118*a* of the fixed contacts 111 and 112.

Because of this Lorentz force, it is possible to oppose the electromagnetic repulsion force generated in the contact opening direction between the flat portions 118*a* of the fixed contacts 111 and 112 and the flat portions 130*a* of the movable contact 130, and thus possible to reliably prevent the flat portions 130*a* of the movable contact 130 from opening. Because of this, it is possible to reduce the pressing force of the contact spring 134 supporting the movable contact 130, and possible to reduce the size of the contact spring 134, and thus possible to reduce the size of the contact device 100.

When interrupting the supply of current to the load in the closed contact condition of the contact mechanism 101, the exciting of the exciting coil 208 of the electromagnet unit 200 is stopped.

By so doing, the exciting force causing the movable plunger 215 to move downward in the electromagnet unit 200 stops, the movable plunger 215 is raised by the urging force of the return spring 214, and the suctioning force of the ring-form permanent magnet 220 increases as the peripheral flange portion 216 nears the auxiliary yoke 225.

By the movable plunger 215 rising, the movable contact 130 connected via the connecting shaft 131 rises. As a result of this, the movable contact 130 is contacting the fixed contacts 111 and 112 for as long as contact pressure is applied by the contact spring 134. Subsequently, there starts an opened contact condition, wherein the movable contact 130 moves upward away from the fixed contacts 111 and 112 at the point at which the contact pressure of the contact spring 134 stops.

On the opened contact condition starting, an arc is generated between the flat portions 118*a* of the fixed contacts 111 and 112 and the flat portions 130*a* of the movable contact 130, and the condition in which current is conducted is continued due to the arc. At this time, the insulating cover 121 is mounted covering the upper plate portion 116 and intermediate plate portion 117 of the contact conductor portion 115 of the fixed contacts 111 and 112. Because of this, it is possible to cause the arc to be generated only between the flat portions 118*a* forming the contact portions of the fixed contacts 111 and 112 and the flat portions 130*a* forming the contact portions of the movable contact 130. Consequently, it is possible to reliably prevent the arc from moving above the contact conductor portion 115 of the fixed contacts 111 and 112, thereby stabilizing the arc generation condition, and thus possible to improve arc extinguishing performance. Moreover, as both side surfaces of the fixed contacts 111 and 112 are also covered by the insulating cover 121, it is also possible to reliably prevent the leading edge of the arc from short circuiting.

Furthermore, the surfaces of the upper plate portion 116 and intermediate plate portion 117 of the contact conductor portion 115 of the fixed contacts 111 and 112 facing the movable contact 130 are covered by the insulating cover 121. Because of this, it is possible to bring the upper plate portion 116 and intermediate plate portion 117 and the movable contact 130 close together while maintaining the necessary insulating distance, and thus possible to reduce the height of the contact mechanism 101, that is, the height in the direction in which the movable contact 130 can move.

Further, as the insulating cover 121 can be mounted on the fixed contacts 111 and 112 simply by the fitting portion 125 being fitted onto the small diameter portion 114*b* of the fixed contacts 111 and 112, it is possible to easily carry out the mounting of the insulating cover 121 on the fixed contacts 111 and 112.

Furthermore, as the inner surface of the intermediate plate portion 117 of the fixed contacts 111 and 112 is covered by the magnetic plate 119, a magnetic field generated by current flowing through the intermediate plate portion 117 is shielded by the magnetic plate 119. Because of this, there is no interference between a magnetic field caused by the arc generated between the flat portions 118*a* of the fixed contacts 111 and 112 and the flat portions 130*a* of the movable contact 130 and the magnetic field generated by the current flowing through the intermediate plate portion 117. Consequently, it is possible to prevent the arc being affected by the magnetic field generated by the current flowing through the intermediate plate portion 117.

At this time, as the opposing magnetic pole faces of the arc extinguishing permanent magnets 143 and 144 are N-poles, and the outer sides thereof are S-poles, magnetic flux emanating from the N-poles, seen in plan view as shown in FIG. 7(*a*), crosses an arc generation portion of a portion in which the flat portion 118*a* of the fixed contact 111 and the flat portion 130*a* of the movable contact 130 are facing each other, from the inner side to the outer side in the longitudinal direction of the movable contact 130, and reaches the S-pole, whereby a magnetic field is formed. In the same way, the magnetic flux crosses an arc generation portion of the flat portion 118*a* of the fixed contact 112 and the flat portion 130*a* of the movable contact 130, from the inner side to the outer side in the longitudinal direction of the movable contact 130, and reaches the S-pole, whereby a magnetic field is formed.

Consequently, the magnetic fluxes of the arc extinguishing permanent magnets 143 and 144 both cross between the flat portion 118*a* forming the contact portion of the fixed contact 111 and the flat portion 130*a* forming the contact portion of the movable contact 130 and between the flat portion 118*a* forming the contact portion of the fixed contact 112 and the flat portion 130*a* forming the contact portion of the movable contact 130, in mutually opposite directions in the longitudinal direction of the movable contact 130.

Because of this, a current I flows from the fixed contact 111 side to the movable contact 130 side between the flat portion 118*a* forming the contact portion of the fixed contact 111 and the flat portion 130*a* forming the contact portion of the movable contact 130, and the orientation of the magnetic flux $\phi$ is in a direction from the inner side toward the outer side, as shown in FIG. 7(*b*). Because of this, in accordance with Fleming's left-hand rule, a large Lorentz force F acts toward the arc extinguishing space 145 side, perpendicular to the longitudinal direction of the movable contact 130 and perpendicular to the switching direction of the flat portion 118*a* of the fixed contact 111 and the movable contact 130, as shown in FIG. 7(*c*).

Due to the Lorentz force F, an arc generated between the flat portion 118*a* forming the contact portion of the fixed contact 111 and the flat portion 130*a* forming the contact portion of the movable contact 130 is greatly extended so as to pass from the side surface of the flat portion 118*a* forming the contact portion of the fixed contact 111 through the inside of the arc extinguishing space 145, reaching the upper surface side of the movable contact 130, and is extinguished.

At this time, by the arc being extended inside the outer side arc extinguishing space 145, the root of the arc on the fixed contact 111 side moves swiftly from the flat portion 118*a* along the tapered surface 118*c* to the back end surface side of the lower plate portion 118, as shown in FIG. 3.

Also, in the same way, on the movable contact 130 side, the root of the arc generated at the flat portion 130*a* moves swiftly along the tapered surface 130*c* to the back end surface side of the movable contact 130.

Consequently, the distance between the arc roots of the fixed contact 111 and movable contact 130 increases considerably, and it is possible to prevent a decrease in electrical field intensity caused by the effect of a metal vapor 150 generated by the arc between the fixed contact 111 and movable contact 130, thus maintaining the electrical field intensity between the arc roots at the arc voltage or higher. Because of this, it is possible to reliably prevent an arc being regenerated between electrodes in the vicinity of the arc roots of the fixed contact 111 and movable contact 130, and thus possible to improve interruption performance.

At this time, due to the arc extinguishing space on the upper side of the movable contact 130 being large, as shown in FIG. 3, the arc root moves easily in a direction of the movable contact 130 opposite to that of the fixed contacts 111 and 112, and extends easily, because of which it is possible to further improve interruption performance.

For the moment, it will be assumed that the fixed contacts 111 and 112 and the movable contact 130 are flat surfaces in which the tapered surfaces 118*b* and 118*c*, and 130*b* and 130*c*, are not formed. In this case, arcs generated between the fixed contacts 111 and 112 and the movable contact 130 remain in a corner portion of the flat surface and a side surface when the arc roots of the fixed contacts 111 and 112 and the movable contact 130 are extended to the arc extinguishing space 145 (or 146) side by the magnetic force of the arc extinguishing permanent magnets 143 and 144. Because of this, the arcs stop with the distance between the fixed contacts 111 and 112 and the arc roots still short, and the electrical field intensity between the arc roots may drop to or below the arc voltage due to metal vapor or the like. As a result of this, the arc is regenerated between electrodes in the vicinity of the arc roots, and interruption performance falls.

Also, at the lower side and upper side of the arc extinguishing space 145, magnetic flux inclines to the lower side and upper side with respect to the orientation of the magnetic flux between the flat portion 118*a* of the fixed contact 111 and the flat portion 130*a* of the movable contact 130. Because of this, the arc extended to the arc extinguishing space 145 is further extended by the inclined magnetic flux in the direction of the corner of the arc extinguishing space 145, it is possible to increase the arc length, and thus possible to obtain good interruption performance.

Meanwhile, the current I flows from the movable contact 130 side to the fixed contact 112 side between the flat portion 118*a* of the fixed contact 112 and the flat portion 130*a* of the movable contact 130, and the orientation of the magnetic flux ϕ is in a rightward direction from the inner side toward the outer side, as shown in FIG. 7(*b*). Because of this, in accordance with Fleming's left-hand rule, a large Lorentz force F acts toward the arc extinguishing space 145, perpendicular to the longitudinal direction of the movable contact 130 and perpendicular to the switching direction of the flat portion 118*a* of the fixed contact 112 and the flat portion 130*a* of the movable contact 130, as shown in FIG. 7(*c*).

Due to the Lorentz force F, an arc generated between the flat portion 118*a* of the fixed contact 112 and the flat portion 130*a* of the movable contact 130 is greatly extended so as to pass from the upper surface side of the movable contact 130 through the inside of the arc extinguishing space 145, reaching the side surface side of the fixed contact 112, and is extinguished.

Also, the fixed contact 112 and movable contact 130 are also such that, when the arc is extended to the arc extinguishing space 145 side, the arc roots move swiftly along the tapered surfaces 118*b* and 130*b* to the front end surface side, and in the same way as in the previously described case of the fixed contact 111 and movable contact 130, the distance between the arc roots of the fixed contact 112 and movable contact 130 increases considerably. Because of this, it is possible to prevent a decrease in electrical field intensity caused by the effect of the metal vapor 150 generated by the arc between the fixed contact 112 and movable contact 130, thus maintaining the electrical field intensity between the arc roots at the arc voltage or higher. Consequently, it is possible to reliably prevent an arc being regenerated between electrodes in the vicinity of the arc roots of the fixed contact 112 and movable contact 130, and thus possible to improve interruption performance.

Also, at the lower side and upper side of the arc extinguishing space 145, as heretofore described, magnetic flux inclines to the lower side and upper side with respect to the orientation of the magnetic flux between the flat portion 118*a* of the fixed contact 112 and the flat portion 130*a* of the movable contact 130. Because of this, the arc extended to the arc extinguishing space 145 is further extended by the inclined magnetic flux in the direction of the corner of the arc extinguishing space 145, it is possible to increase the arc length, and thus possible to obtain good interruption performance.

Meanwhile, when adopting a released condition in a condition wherein a regenerative current flows from the load side to the direct current power source side in the engaged condition of the electromagnetic contactor 10, the direction of current in FIG. 7(*b*) is reversed, meaning that the Lorentz force F acts on the arc extinguishing space 146 side, and excepting that the arc is extended to the arc extinguishing space 146 side, the same arc extinguishing function is fulfilled.

At this time, as the arc extinguishing permanent magnets 143 and 144 are disposed in the magnet housing cylinders 141 and 142 formed in the insulating cylinder 140, the arc does not directly contact the arc extinguishing permanent magnets 143 and 144. Because of this, it is possible to stably maintain the magnetic characteristics of the arc extinguishing permanent magnets 143 and 144, and thus possible to stabilize interruption performance.

Also, as it is possible to cover and insulate the inner peripheral surface of the metal tubular body 104 with the insulating cylinder 140, there is no short circuiting of the arc when the current is interrupted, and it is thus possible to reliably carry out current interruption.

Furthermore, as it is possible to carry out the insulating function, the function of positioning the arc extinguishing permanent magnets 143 and 144, the function of protecting the arc extinguishing permanent magnets 143 and 144 from the arc, and the insulating function preventing the arc from reaching the external metal tubular body 104 with the one insulating cylinder 140, it is possible to reduce manufacturing cost.

Also, as the movable contact guide members 148 and 149 that slide against a side edge of the movable contact are formed protruding on the magnet housing cylinders 141 and 142 housing the arc extinguishing permanent magnets 143 and 144 in positions facing the movable contact 130, it is possible to reliably prevent turning of the movable contact 130.

Also, as it is possible to increase the distance between the side edges of the movable contact 130 and the inner peripheral surface of the insulating cylinder 140 by the thickness of the arc extinguishing permanent magnets 143 and 144, it is possible to provide sufficient arc extinguishing spaces 145 and 146, and thus possible to reliably carry out arc extinguishing.

In this way, according to the embodiment, when the contacts are opened from an engaged condition wherein the flat portion 130*a* of the movable contact 130 is contacting the flat portion 118*a* of the fixed contacts 111 and 112, causing the flat portion 130*a* of the movable contact 130 to move away from the flat portion 118*a* of the fixed contacts 111 and 112, an arc is generated between the flat portion 130*a* of the movable contact 130 and the flat portion 118*a* of the fixed contacts 111 and 112.

The arc is extended to the arc extinguishing space 145 or 146 by the magnetic force of the arc extinguishing permanent magnets 143 and 144. At this time, the tapered surfaces 118*b* and 118*c* configuring the first arc root movement promotion portion are formed in the fixed contacts 111 and 112, and the tapered surfaces 130*b* and 130*c* configuring the second arc root movement promotion portion are formed in the movable contact 130.

Because of this, the arc roots move swiftly to the outer side along the tapered surfaces 118*b* and 118*c* and 130*b* and 130*c*, without stopping between the flat portions 118*a* and 130*a*, and the distance between the arc roots increases. Consequently, it is possible to prevent a decrease in electrical field intensity caused by the effect of the metal vapor 150 generated by the arc between the fixed contact 112 and movable contact 130, thus maintaining the electrical field intensity between the arc roots at the arc voltage or higher. Because of this, it is possible to reliably prevent the arc being regenerated between electrodes in the vicinity of the arc roots of the fixed contact 112 and movable contact 130, and thus possible to improve interruption performance.

Also, a C-shape is adopted for the contact conductor portions 115 of the pair of fixed contacts 111 and 112, the intermediate plate portion 117 and upper plate portion 116 are disposed in proximity to the flat portion 118*a* so as to generate a Lorentz force opposing the electromagnetic repulsion force in the engaged condition, and furthermore, the contact conductor portions 115 of the pair of fixed contacts 111 and 112 and the contact spring 134 can be disposed in a parallel condition in the extension direction of the movable contact 130. Because of this, it is possible to reduce the height of the contact device 100, and also possible to reduce the width, and thus possible to reduce the whole size of the contact device 100.

Moreover, it is possible to generate a Lorentz force opposing the electromagnetic repulsion force generated when engaging in the contact conductor portions 115 of the fixed contacts 111 and 112 between the flat portion 118*a* of the fixed contacts 111 and 112 and the flat portion 130*a* of the movable contact 130. Because of this, it is possible to reduce the urging force of the contact spring 134, thus reducing the size thereof, and possible to reduce the height of the contact device 100 by this amount too. Furthermore, the depressed portion 132 protruding on the side opposite to that of the fixed contact support insulating substrate 105 forming an upper plate, that is, the lower side, is formed in the position in which the movable contact 130 contacts the contact spring 134, because of which it is possible to further reduce the protruding height of the contact spring 134.

Incidentally, when omitting the contact conductor portion 115, forming a contact portion on the lower end of the support conductor portion 114, and disposing the movable contact 130 so as to be capable of contacting to and separating from the contact portion from below, the contact spring, movable contact, and fixed contacts are disposed in series in a vertical direction, and the height of the contact device 100 increases.

Figure 9:
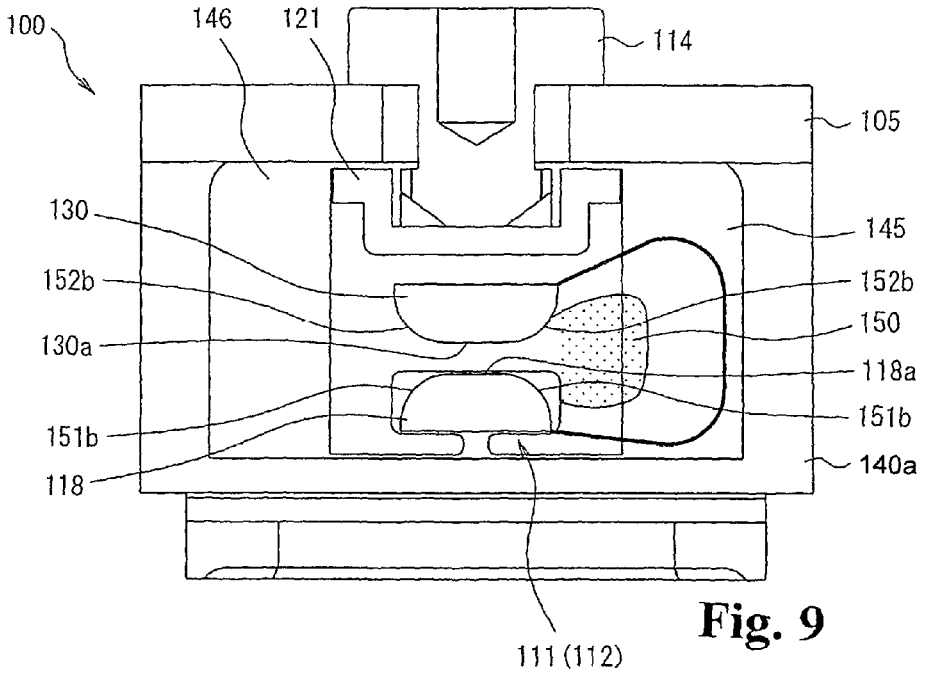
FIG. 9 is a schematic sectional view the same as FIG. 3, showing a modification example of the first embodiment of the invention.

In the first embodiment, a description has been given of a case wherein the first arc root movement promotion portion is configured of the tapered surfaces 118*b* and 118*c*, and the second arc root movement promotion portion is configured of the tapered surfaces 130*b* and 130*c*. However, the invention not being limited to the heretofore described configurations, arc-like curved surfaces 151*a* and 151*b* and 152*a* and 152*b* forming one portion of a cylindrical surface may be adopted in place of the tapered surfaces 118*b* and 118*c* and 130*b* and 130*c*, as shown in FIG. 9. In this case, it is possible to increase the distance between the arc roots of the fixed contacts 111 and 112 and the movable contact 130 as the arc roots move to the outer side along the arc-like curved surfaces 151*a* (or 151*b*) and 152*a* (or 152*b*), and thus possible to further improve interruption performance.

Next, a description will be given of a second embodiment of the invention, based on FIG. 10.

In the second embodiment, the configuration of the first arc root movement promotion portion formed in the fixed contacts 111 and 112 is changed.

Figure 10:
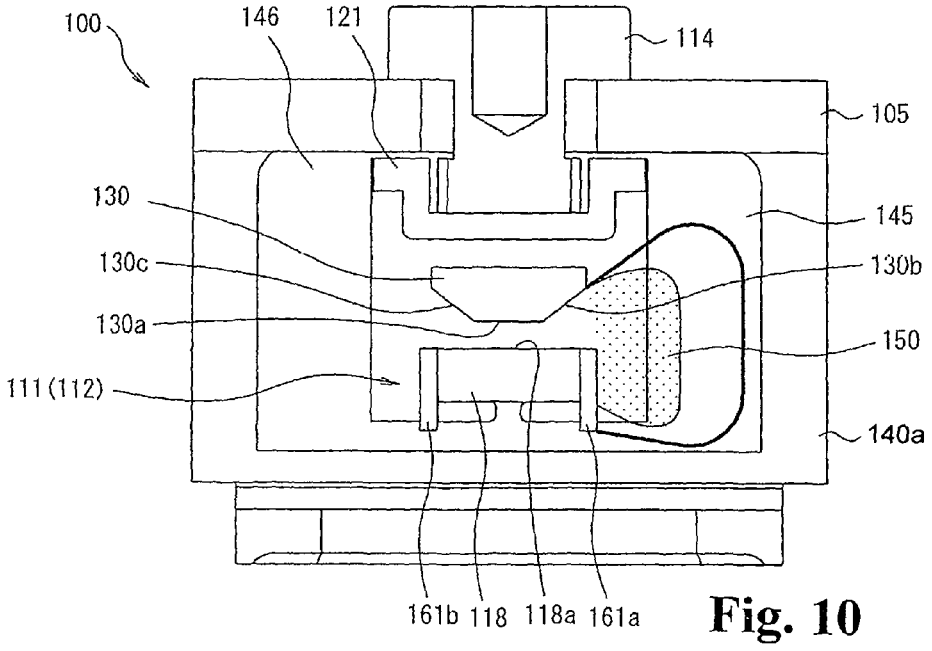
FIG. 10 is a schematic sectional view the same as FIG. 3, showing a second embodiment of the invention.

In the second embodiment, as shown in FIG. 10, a rectangular sectional form is maintained for the sectional form of the fixed contacts 111 and 112 in the forward-back direction perpendicular to the direction of current, but plate-like arc runners 161*a* and 161*b* are fixed to the front and back side surfaces as first arc root movement promotion portions that cover the side surfaces and protrude extending downward. Herein, each of the arc runners 161*a* and 161*b* is formed of a metal material that has conductivity as well as having arc resistance, such as tungsten (W) or silver (Ag).

The second embodiment has the same configuration as the first embodiment with the exception of the configuration described above, the same reference numbers are given to portions corresponding to FIG. 3, and a detailed description thereof will be omitted.

According to the second embodiment, an arc generated between the movable contact 130 and fixed contacts 111 and 112 when contacts are opened and the movable contact 130 moves away from the fixed contacts 111 and 112 is extended to the arc extinguishing space 145 (or 146) side by the magnetic force of the arc extinguishing permanent magnets 143 and 144, in the same way as in the first embodiment.

At this time, as the movable contact 130 has the same configuration as in the first embodiment, the arc root moves swiftly to an end surface side along the tapered surface 130*b* (or 130*c*) in accordance with being extended to the arc extinguishing space 145 (or 146) side.

Meanwhile, on the fixed contact 111 and 112 side, the arc root moves to the side surface arc runner 161*a* (or 161*b*) side in accordance with the arc being extended to the arc extinguishing space 145 (or 146) side by the magnetic force of the arc extinguishing permanent magnets 143 and 144. When the arc root reaches the arc runner 161*a* (or 161*b*), the arc root moves quickly downward along the arc runner 161*a* (or 161*b*), as shown in FIG. 10. Because of this, the arc root does not stop in a corner portion of a side surface of the fixed contacts 111 and 112, and it is possible to increase the distance from the arc root of the movable contact 130, thus preventing a decrease in electrical field intensity caused by a metal vapor or the like. Consequently, in the same way as in the first embodiment, it is possible to easily extinguish the arc, thus improving interruption performance.

At this time, as the arc root of the fixed contacts 111 and 112 moves to an end surface of the arc runner 161*a* (or 161*b*) lower than the lower plate portion 118 of the fixed contacts 111 and 112, it is possible for the arc extension length to be greater than the arc extension length in the first embodiment, and thus possible to better extinguish the arc.

Figure 11A:
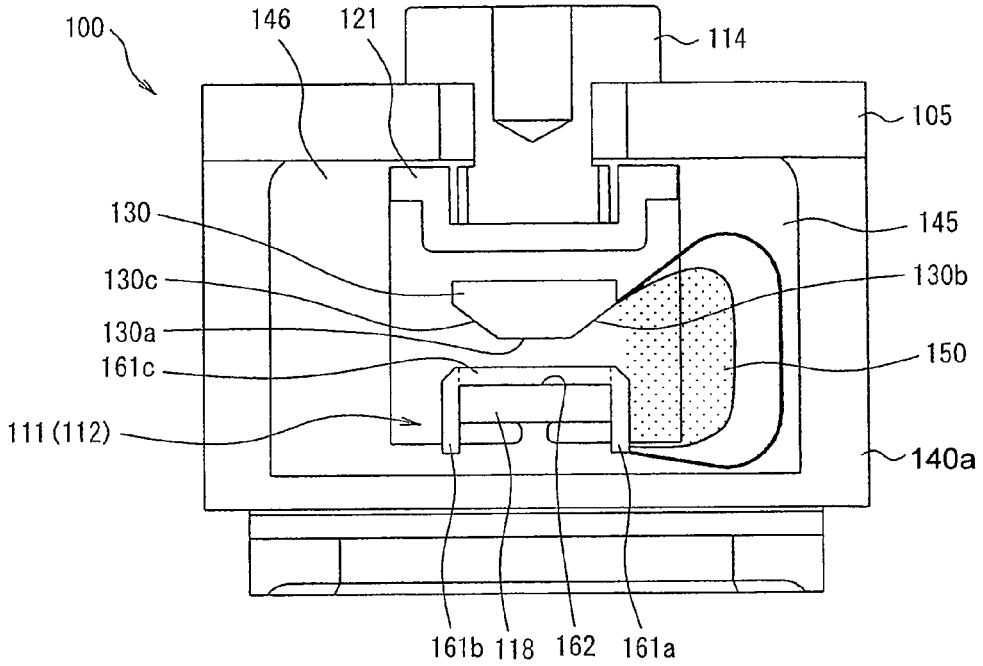
FIGS. 11(*a*), 11(*b*) are schematic sectional views the same as FIG. 3, showing a modification example of the second embodiment of the invention.
Figure 11B:
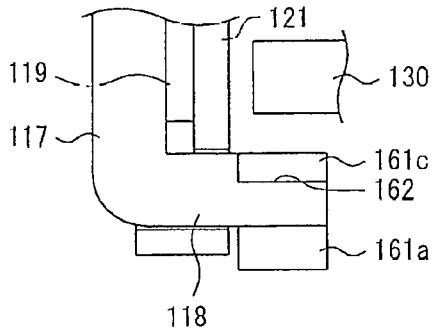

In the second embodiment, a description has been given of a case wherein the arc runners 161*a* and 161*b* are formed so as to cover the side surfaces of the fixed contacts 111 and 112 but, not being limited to this, the arc runners 161*a* and 161*b* may be configured as shown in FIGS. 11(*a*), 11(*b*). That is, as shown in FIG. 11(*a*), front and back upper end portions of the two arc runners 161*a* and 161*b* may be linked by a connecting portion 161*c* facing the movable contact 130, forming an inverted U-shape in cross-section. In this case, as shown in FIG. 11(*b*), a groove portion 162 extending in the front-back direction is formed in the surface of the fixed contacts 111 and 112 opposing the movable contact 130, and the connecting portion 161*c* is fitted into and fixed in the groove portion 162. By the arc runner being formed in an inverted U-shape in this way, the movement of the arc root along the connecting portion 161*c* can be carried out smoothly, and the fixing of the arc runner to the fixed contacts 111 and 112 can be carried out easily.

Next, a description will be given of a third embodiment of the invention, based on FIG. 12 and FIG. 2(*b*).

In the third embodiment, the configuration of the contact housing case 102 is changed.

Figure 12:
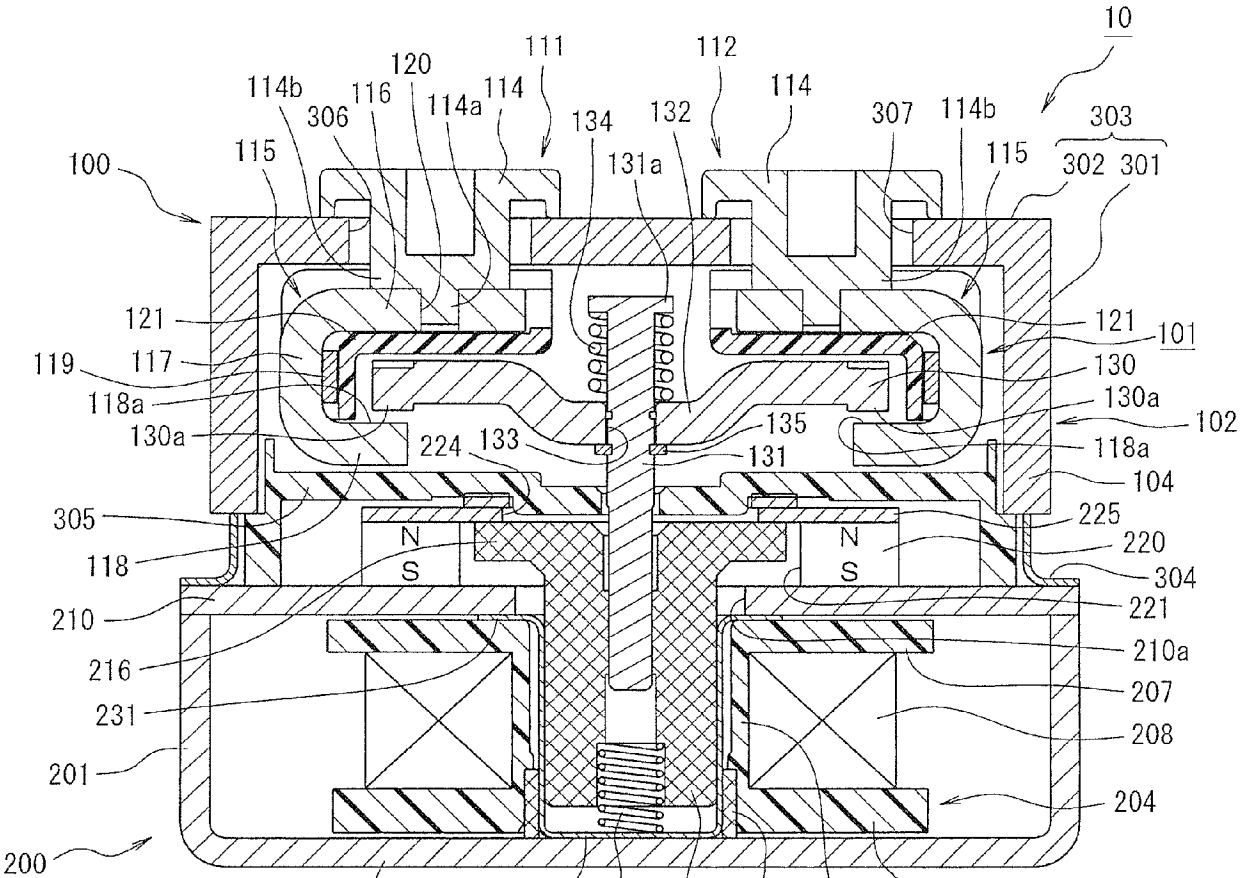
FIG. 12 is a sectional view showing a third embodiment of the invention.

That is, in the third embodiment, the contact housing case 102 is configured of a tubular portion 301 and an upper surface plate portion 302 closing off the upper end of the tubular portion 301 being formed integrally of a ceramic or a synthetic resin material, thereby forming a tub-form body 303, a metal foil being formed on an opened end surface side of the tub-form body 303 by a metalizing process, and a metal connection member 304 being seal joined to the metal foil, as shown in FIG. 12 and FIG. 2(*b*).

Further, a bottom plate portion 305 formed of, for example, a synthetic resin, corresponding to the bottom plate portion 140*b* in the first embodiment, is disposed on the inner peripheral surface on the bottom surface side of the tub-form body 303.

Also, insertion holes 306 and 307 in which are inserted the fixed contacts 111 and 112 are formed in the upper surface plate portion 302, in the same way as in the fixed contact support insulating substrate 105, and the fixed contacts 111 and 112 are supported by the insertion holes 306 and 307, in the same way as in the first embodiment.

Configurations other than this have the same configurations as in the first embodiment, the same reference signs are given to portions corresponding to FIG. 1, and a detailed description thereof will be omitted.

According to the third embodiment, the contact housing case 102 is configured of the tub-form body 303 integrally molded of an insulating material, because of which it is possible to easily form the airtight contact housing case 102 in a small number of man-hours, and possible to reduce the number of parts.

In the first to third embodiments, a description has been given of a case wherein the opposing magnetic pole faces of the arc extinguishing permanent magnets 143 and 144 are N-poles but, not being limited to this, it is also possible to obtain the same advantages as in the heretofore described embodiments when arranging so that the opposing magnetic pole faces of the arc extinguishing permanent magnets 143 and 144 are S-poles, with an exception that the direction in which the magnetic flux crosses the arc and the direction of the Lorentz force are reversed.

Also, in the first to third embodiments, a description has been given of a case wherein the contact housing case 102 is formed by brazing the metal tubular body 104 and the fixed contact support insulating substrate 105 that closes off the upper end of the tubular body 104, but not being limited to this, the contact housing case 102 may be integrally formed in a tub-form of an insulating material, such as a ceramic or a synthetic resin material.

Figure 13A:
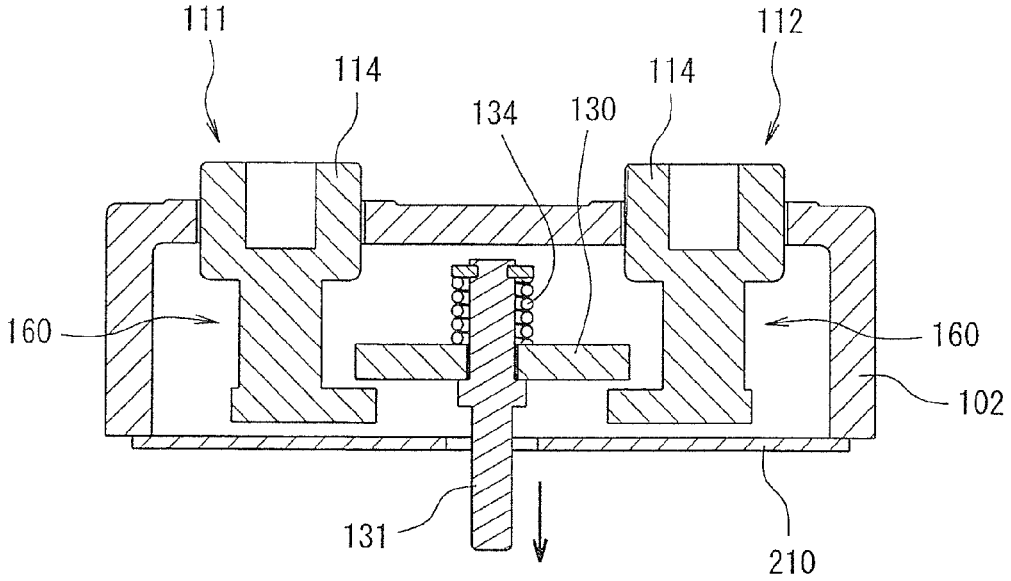
FIGS. 13(*a*), 13(*b*) are diagrams showing a modification example of the contact device of the invention, wherein FIG. 13(*a*) is a sectional view and FIG. 13(*b*) is a perspective view.
Figure 13B:
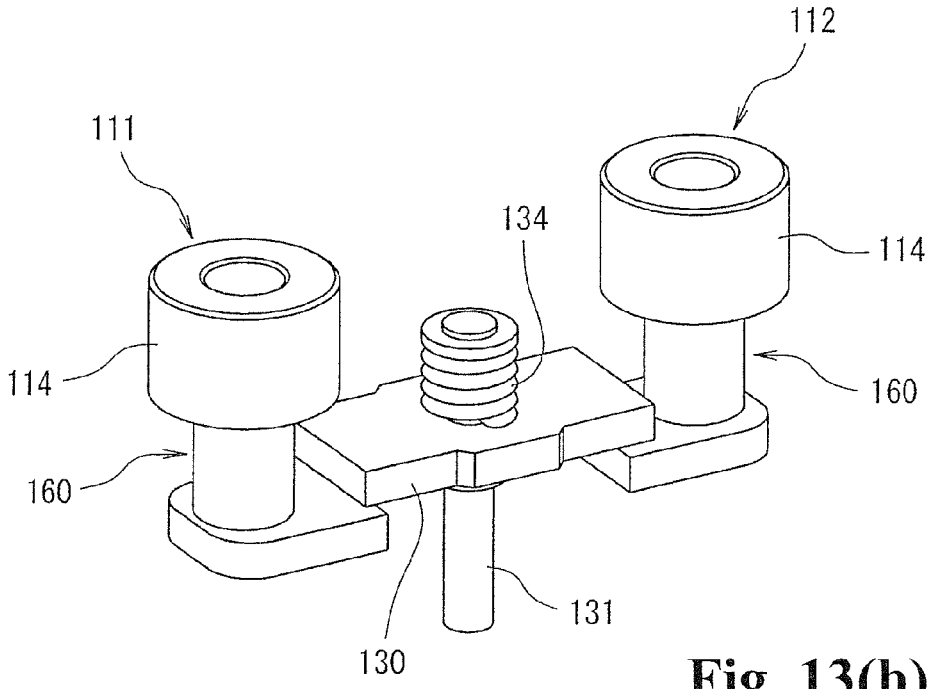

Also, in the first to third embodiments, a description has been given of a case wherein the contact conductor portion 115 is formed in the fixed contacts 111 and 112 but, not being limited to this, an L-shaped portion 160, of a form such that the upper plate portion 116 of the contact conductor portion 115 is omitted, may be linked to the support conductor portion 114, as shown in FIGS. 13(*a*) and 13(*b*).

In this case too, in the closed contact condition wherein the movable contact 130 contacts the fixed contacts 111 and 112, it is possible to cause magnetic flux generated by the current flowing through a vertical plate portion of the L-shaped portion 160 to act on portions in which the fixed contacts 111 and 112 and the movable contact 130 are contacting each other. Because of this, it is possible to increase the magnetic flux density in the portions in which the fixed contacts 111 and 112 and the movable contact 130 are contacting each other, generating a Lorentz force that opposes the electromagnetic repulsion force.

Figure 14A:
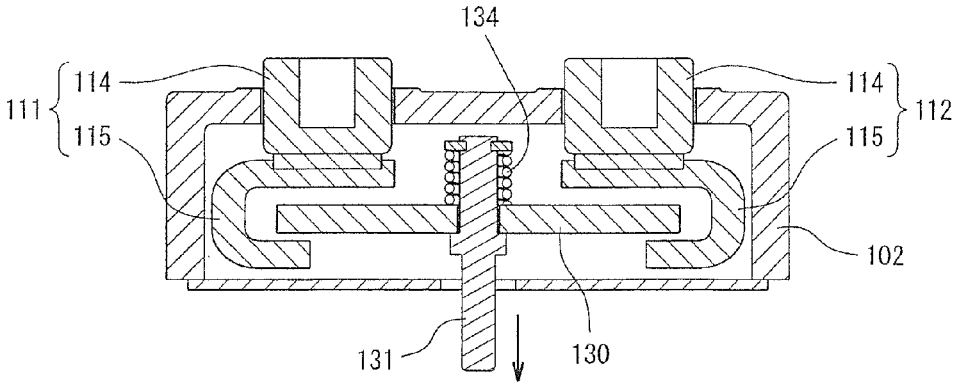
FIGS. 14(*a*), 14(*b*) are diagrams showing another modification example of the contact device of the invention, wherein FIG. 14(*a*) is a sectional view and FIG. 14(*b*) is a perspective view.
Figure 14B:
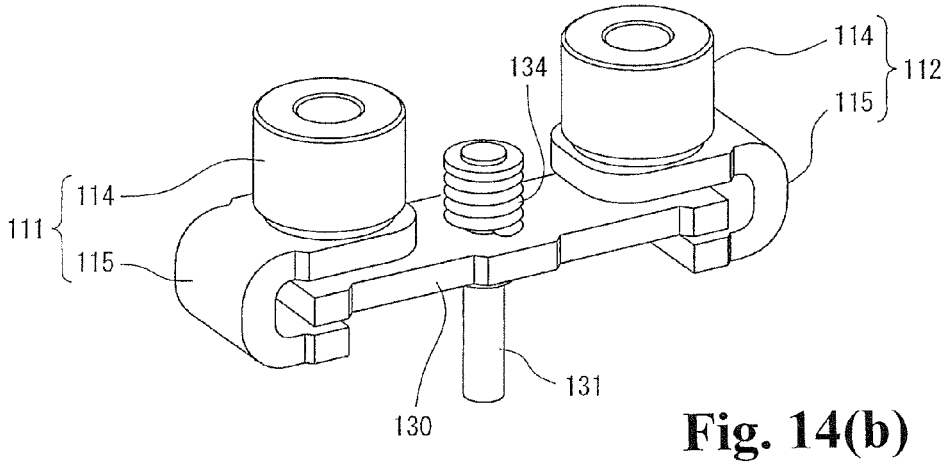

Also, in the first to third embodiments, a description has been given of a case wherein the movable contact 130 has the depressed portion 132 in a central portion thereof but, not being limited to this, the depressed portion 132 may be omitted, forming a flat plate, as shown in FIGS. 14(*a*) and 14(*b*).

Also, in the first and third embodiments, a description has been given of a case wherein the connecting shaft 131 is screwed to the movable plunger 215, but the movable plunger 215 and connecting shaft 131 may also be formed integrally.

Also, a description has been given of a case wherein the connection of the connecting shaft 131 and movable contact 130 is such that the flange portion 131*a* is formed on the leading end portion of the connecting shaft 131, and the lower end of the movable contact 130 is fixed with a C-ring after the connecting shaft 131 is inserted into the contact spring 134 and movable contact 130, but not being limited to this, a positioning large diameter portion may be formed protruding in a radial direction in the C-ring position of the connecting shaft 131, the contact spring 134 disposed after the movable contact 130 contacts the large diameter portion, and the upper end of the contact spring 134 fixed with the C-ring.

Also, in the first to third embodiments, a description has been given of a case wherein a hermetic receptacle is configured of the contact housing case 102 and cap 230, and gas is encapsulated inside the hermetic receptacle but, not being limited to this, the gas encapsulation may be omitted when the interrupted current is small.

INDUSTRIAL APPLICABILITY

According to the invention, it is possible to provide a contact device, and an electromagnetic switch in which the contact device is used, such that an arc generated between a fixed contact and a movable contact when the contacts are opened can be easily extinguished.

REFERENCE SIGNS LIST

10 . . . Electromagnetic contactor, 11 . . . External insulating receptacle, 100 . . . Contact device, 101 . . . Contact mechanism, 102 . . . Contact housing case (arc extinguishing chamber), 104 . . . Metal tubular body, 105 . . . Fixed contact support insulating substrate, 111, 112 . . . Fixed contact, 114 . . . Support conductor portion, 115 . . . Contact conductor portion, 116 . . . Upper plate portion, 117 . . . Intermediate plate portion, 118 . . . Lower plate portion, 118*a* . . . Flat portion, 118*b*, 118*c* . . . Tapered surface (first arc root movement promotion portion), 121 . . . Insulating cover, 122 . . . L-shaped plate portion, 123, 124 . . . Side plate portion, 125 . . . Fitting portion, 130 . . . Movable contact, 130*a* . . . Flat portion, 130*b*, 130*c* . . . Tapered surface (second arc root movement promotion portion), 131 . . . Connecting shaft, 132 . . . Depressed portion, 134 . . . Contact spring, 140 . . . Insulating cylinder, 141, 142 . . . Magnet housing cylinder, 143, 144 . . . Arc extinguishing permanent magnet, 145, 146 . . . Arc extinguishing space, 161*a*, 161*b* . . . Arc runner, 161*c* . . . Connecting portion, 160 . . . L-shaped portion, 200 . . . Electromagnet unit, 201 . . . Magnetic yoke, 203 . . . Cylindrical auxiliary yoke, 204 . . . Spool, 208 . . . Exciting coil, 210 . . . Upper magnetic yoke, 214 . . . Return spring, 215 . . . Movable plunger, 216 . . . Peripheral flange portion, 220 . . . Permanent magnet, 225 . . . Auxiliary yoke, 301 . . . Tubular portion, 302 . . . Upper surface plate portion, 303 . . . Tub-form body, 304 . . . Connection member, 305 . . . Bottom plate portion

What is claimed is:

1. A contact device, comprising:

a pair of fixed contacts fixedly disposed inside an arc extinguishing chamber to maintain a predetermined interval from each other;

a movable contact disposed inside the arc extinguishing chamber, and contacting to and separating from the pair of fixed contacts;

a first arc root movement promotion portion formed on each of the pair of fixed contacts, and promoting a movement of a root of an arc in a direction away from the movable contact, the arc being generated when contacts are opened in which the movable contact moves away from the pair of fixed contacts; and a second arc root movement promotion portion formed on the movable contact, and promoting a movement of the root of the arc in a direction away from the fixed contacts, the arc being generated when the contacts are opened in which the movable contact moves away from the pair of fixed contacts, wherein the first arc root movement promotion portion formed in each of the pair of fixed contacts includes arc runners in a form of a plate formed separately from each of the fixed contacts, the plates as the arc runners being two arranged on two side surfaces, opposite to each other, of each of the pair of fixed contacts to sandwich each of the fixed contacts between the two plates, the plates being parallel to an extending direction of the movable contact and a direction of current flow in each of the pair of fixed contacts, and protruding to a direction opposite to the movable contact beyond each of the pair of fixed contact.

2. The contact device according to claim 1, wherein each of the pair of fixed contacts is formed in a C-shape with an inner side being opened, including an upper surface plate portion, a lower surface plate portion disposed to maintain a predetermined interval from the upper surface plate portion, and a connecting plate portion linking outer ends of the upper surface plate portion and lower surface plate portion, and the movable contact is movably disposed between the upper surface plate portion and lower surface plate portion.

3. The contact device according to claim 1, wherein the second arc root movement promotion portion is an inclined surface in which a thickness of an end portion of the movable contact decreases along a direction perpendicular to a direction of current flow in the movable contact.

4. The contact device according to claim 3, wherein the inclined surface is a tapered surface.

5. The contact device according to claim 3, wherein the inclined surface is an arc-shaped curved surface.

6. The contact device according to claim 3, wherein each of the pair of fixed contacts has a rectangular shape in cross section perpendicular to the current flow of the pair of fixed contacts, and each of the arc runners has a rectangular shape with a lateral surface fixed on each side surface of each of the pair of fixed contacts and protrudes downwardly beyond a lower surface of each of the pair of fixed contacts.

7. The contact device according to claim 6, wherein the movable contact includes two inclined surfaces, and a flat portion between the two inclined surfaces, a distance of the flat portion between the two inclined surfaces being less than a distance of each of the pair of fixed contacts between the arc runners.

8. The contact device according to claim 6, wherein each of the pair of fixed contacts further has a flat upper surface, and upper edges of the plates as the arc runners with the rectangular shape are flush with the flat upper surface of the fixed contact.

9. An electromagnetic switch comprising:

a contact device according to claim 1, wherein the movable contact is linked to a movable iron core of an electromagnet device, and the pair of fixed contacts is connected to an external connection terminal.

10. A contact device, comprising:

a pair of fixed contacts fixedly disposed inside an arc extinguishing chamber to maintain a predetermined interval from each other;

a movable contact disposed inside the arc extinguishing chamber, and contacting to and separating from the pair of fixed contacts;

a first arc root movement promotion portion formed on each of the pair of fixed contacts, and promoting a movement of a root of an arc in a direction away from the movable contact, the arc being generated when contacts are opened in which the movable contact moves away from the pair of fixed contacts; and a second arc root movement promotion portion formed on the movable contact, and promoting a movement of the root of the arc in a direction away from the fixed contacts, the arc being generated when the contacts are opened in which the movable contact moves away from the pair of fixed contacts, wherein the first arc root movement promotion portion formed in each of the pair of fixed contacts includes arc runners in a form of a plate formed separately from each of the fixed contacts, the plates as the arc runners being arranged on two side surfaces of each of the pair of fixed contacts parallel to an extending direction of the movable contact and a direction of current flow in each of the pair of fixed contacts, and protruding to a direction opposite to the movable contact beyond each of the pair of fixed contact, and a connecting plate portion is disposed in a plane facing the movable contact and linking the arc runners on the two side surfaces.

* * * * *